US010170843B2

(12) United States Patent
Thomson et al.

(10) Patent No.: US 10,170,843 B2
(45) Date of Patent: Jan. 1, 2019

(54) PARABOLIC DEPLOYABLE ANTENNA

(71) Applicant: CALIFORNIA INSTITUTE OF TECHNOLOGY, Pasadena, CA (US)

(72) Inventors: Mark W. Thomson, Pasadena, CA (US); Richard E. Hodges, Pasadena, CA (US); Nacer E. Chahat, Pasadena, CA (US); Jonathan Sauder, Pasadena, CA (US); Yahya Rahmat-Samii, Pasadena, CA (US); Brian Hirsh, Long Beach, CA (US)

(73) Assignee: CALIFORNIA INSTITUTE OF TECHNOLOGY, Pasadena, CA (US)

( * ) Notice: Subject to any disclaimer, the term of this patent is extended or adjusted under 35 U.S.C. 154(b) by 114 days.

(21) Appl. No.: 15/167,703

(22) Filed: May 27, 2016

(65) Prior Publication Data

US 2016/0352022 A1 Dec. 1, 2016

Related U.S. Application Data

(60) Provisional application No. 62/168,118, filed on May 29, 2015.

(51) Int. Cl.

| | |
|---|---|
| ***H01Q 19/19*** | (2006.01) |
| ***H01Q 19/13*** | (2006.01) |
| ***H01Q 15/16*** | (2006.01) |
| ***H01Q 1/28*** | (2006.01) |
| ***H01Q 13/02*** | (2006.01) |

(52) U.S. Cl.

CPC ..... *H01Q 19/19* (2013.01); *H01Q 1/288* (2013.01); *H01Q 13/02* (2013.01); *H01Q 15/162* (2013.01); *H01Q 19/132* (2013.01)

(58) Field of Classification Search

CPC .... H01Q 1/288; H01Q 15/161; H01Q 15/162; H01Q 19/132; H01Q 19/19

See application file for complete search history.

(56) References Cited

U.S. PATENT DOCUMENTS

| | | | |
|---|---|---|---|
| 4,812,792 | A | 3/1989 | Leibowitz |
| 5,666,128 | A | 9/1997 | Murray et al. |
| 5,966,104 | A | 10/1999 | Massey et al. |
| 6,081,234 | A | 6/2000 | Huang et al. |
| 6,229,501 | B1 | 5/2001 | Roth et al. |
| 6,243,051 | B1 | 6/2001 | Vanstrum et al. |
| 6,320,553 | B1 | 11/2001 | Ergene |
| 6,448,940 | B1 | 9/2002 | Chiang |
| 8,289,221 | B1 | 10/2012 | Finucane |
| 8,604,997 | B1 | 12/2013 | Cencich, Sr. et al. |
| 9,555,904 | B2 | 1/2017 | Abrams et al. |
| 9,637,247 | B2 | 5/2017 | Cook et al. |

(Continued)

OTHER PUBLICATIONS

"MISC 3: 3U nanosatellite Bus: Hardware Revision: A" cubesatkit.com/docs/datasheet/DS_MISC_3_715-00930-A.pdf, accessed Feb. 20, 2015. 5 pgs.

(Continued)

*Primary Examiner* — Robert Karacsony

(74) *Attorney, Agent, or Firm* — Steinfl + Bruno, LLP

(57) ABSTRACT

A deployable antenna is described. The antenna comprises a mesh attached to foldable ribs, a hub and a sub-reflector. The antenna can be stowed in a tight space for launching in space, and later deployed by extending out of its container. The antenna is designed to work in the Ka band or other bands and can increase data rates and function as a radio antenna.

25 Claims, 25 Drawing Sheets

(56) References Cited

U.S. PATENT DOCUMENTS

| | | | |
|---|---|---|---|
| 9,651,569 | B1 | 5/2017 | Putnam |
| 2004/0113863 | A1 | 6/2004 | Stonier |
| 2005/0219138 | A1 | 10/2005 | Obert et al. |
| 2006/0109179 | A1 | 5/2006 | Humpfer et al. |
| 2007/0132645 | A1 | 6/2007 | Ginn et al. |
| 2007/0216586 | A1 | 9/2007 | Soiron et al. |
| 2012/0068019 | A1 | 3/2012 | Boccio et al. |
| 2012/0193015 | A1 | 8/2012 | Segal et al. |
| 2013/0069849 | A1 | 3/2013 | Toledo |
| 2013/0207880 | A1 | 8/2013 | Taylor et al. |
| 2013/0293436 | A1 | 11/2013 | Blech |
| 2015/0185425 | A1 | 7/2015 | Gundel et al. |
| 2015/0372374 | A1 | 12/2015 | Judd et al. |
| 2016/0197394 | A1 | 7/2016 | Harvey et al. |
| 2017/0093046 | A1 | 3/2017 | Harvey et al. |
| 2017/0110803 | A1 | 4/2017 | Hodges et al. |

OTHER PUBLICATIONS

Aherne, M.R. et al. "Aeneas—Colony I meets three-axis pointing" 25th Annual AIAA/USU Conference on Small Satellites, Aug. 7-12, 2011. 11 pgs.

Freeland, R. et al. "Inflatable Antenna Technology With Preliminary Shuttle Experiment Results and Potential Applications" 18th Annual Meeting and Symposium, Antenna Measurement Techniques Association, Seattle, WA, Sep. 30-Oct. 3, 1996, 6 pages.

Han, C. et al. "A High Efficiency Offset-Fed X/Ka-Dual-Band Reflectarray Using Thin Membranes" IEEE Transactions on Antennas and Propagation, vol. 53, No. 9, Sep. 2005, pp. 2792-2798.

Hodges, R. et al. "ISARA—Integrated Solar Array and Reflectarray mission overview," *Small Satellite Conference Workshop*, Aug. 10, 2013. 16 pgs.

Hodges, R. et al. "Novel deployable reflectarray antennas for CubeSat communications" *IEEE MTT-S International Microwave Symposium* (*IMS*), Phoenix, AZ, May 2015. pp. 4.

Johnson, M. et al. "The Galileo high gain antenna deployment anomaly" JPL Technical Report, May 1994. 20 pages.

MacGillivray, C.S. "Miniature Deployable High Gain Antenna for CubeSats" *2011 CubeSat Developers Workshop*, California Polytechnic State University, San Luis Obispo, CA; Apr. 22, 2011, 11 pages.

Swartwout, M., "The First 272 CubeSats," EEE Parts for Small Missions Workshop, *NASA GSFC*, Sep. 11, 2014. pp. 23.

Swartwout, M., "The First One Hundred CubeSats: A Statistical Look" *JoSS*, vol. 2, No. 2, pp. 213-233, 2013.

Bassily et al., "Chapter 8: Deployable reflectors" from "Handbook of reflector antennas and feed systems vol. III: applications of reflectors," Artech House, Norwood, MA, USA, 2013, pp. 341-383.

Tankersley et al., "Largest Mesh Deployable Antenna Technology" (Apr. 1, 1982).The Space Congress® Proceedings. Paper 4; 22 pages.

Babuscia, A. et al., "Inflatable Antenna for Cubesats: Motivation for Development and Antenna Design.", Acta Astronautica, vol. 91, pp. 322-332, (2013), 13 pages.

Bialkowski, M. et al., "Dual Linearly Polarized Reflectarray Using Aperture Coupled Microstrip Patches.", Antennas and Propagation Society International Symposium., IEEE, (2001), 4 pages.

Chahat, N. et al., "CubeSat Deployable Ka-Band Reflector Antenna for Deep Space Missions.", APS/URSI, Vancouver, Canada, pp. 2185-2186, (Jul. 2015).

Chahat, N. et al., "Enabling Deep Space Cubesat Missions.", Mars CubeSat/NanoSat Workshop, Pasadena, (Nov. 20-21, 2014), 9 pages.

"Cool Gas Generator Technologies" [Online]. Available: http://cgg-technologies.com/. [Accessed: Oct. 17, 2014], 16 pages.

Corkish, R., "The Use of Conical Tips to Improve the Impedance Matching of Cassegrain Subreflectors.", Microw. Optical Techn. Letters, vol. 3, No. 9, pp. 310-313, (1990), 6 pages.

Focardi, P. et al., "A 6-m Mesh Reflector Antenna for SMAP: Modeling the RF Performance of a Challenging Earth-Orbiting Instrument.", IEEE Int. Symp. Antennas Propag. (APSURSI), pp. 2987-2990, (Jul. 3-8, 2011).

Granet, C., "Designing Classical Offset Cassegrain or Gregorian Dual-Reflector Antennas from Combinations of Prescribed Geometric Parameters.", IEEE Antennas Propag. Mag., vol. 44, No. 3, pp. 114-123, (Jun. 2002).

Hanayama, E. et al., "Characteristics of the Large Deployable Antenna on HALCA Satellite in Orbit.", IEEE Trans. Antennas Propag., vol. 52, No. 7, pp. 1777-1782, (Jul. 2004).

Hodges, R. et al., "Integrated Solar Array and Reflectarray Antenna (ISARA): Readying for Launch.", 8th Government CubeSat Technical Exchange, Huntsville, AL., (May 24, 2016), 7 pages.

Hodges, R. et al., "ISARA—Integrated Solar Array and Reflectarray Antenna CubeSat Deployable Ka-Band Antenna.", Proc. 2015 Ant. Prop. Soc. Int. Symp., Vancouver, B.C., (Jul. 2015), 3 pages.

Hodges, R. et al., "Ka-Band Reflectarray for Interferometric SAR Altimeter.", Joint IEEE/URSI Int. Symp. On Antennas and Propagat., Chicago, Il., (Jul. 8-14, 2012), 2 pages.

Hodges, R. et al., "The Mars Cube One Deployable High Gain Antenna.", Proc. 2016 Ant. Prop. Soc. Int. Symp., Fajardo, Puerto Rico, pp. 1533-1534 (Jun. 26-Jul. 1, 2016).

Ingerson, P.G. et al., "The Analysis of Deployable Umbrella Parabolic Reflectors.", IEEE Trans. Antennas Propag., vol. 20, No. 4, pp. 409-414, (Jul. 1972).

Peral, E. et al., "RainCube: A Proposed Constellation of Precipitation Profiling Radars in Cubesat.", AGU Fall Meeting, San Francisco, pp. 1261-1264 (Dec. 2014).

Rahmat-Samii, Y., "An Efficient Computational Method for Characterizing the Effects of Random Surface Errors on the Average Power Pattern of Reflectors.", IEEE Trans. Antennas Propag., vol. 31, pp. 92-98, (Jan. 1983).

Reynolds, W.D. et al., "Highly Compact Wrapped-Gore Deployable Reflector.", in 52nd AIAA/ASMA/ASCE/AHS/ASC Structures, Structural Dynamics and Materials Conference, (2011), 12 pages.

Roederer. A.G. et al., "Unfurlable Satellite Antennas: A Review.", Annales Des Telecommunications, vol. 44, No. 9-10, pp. 475-488, (Sep./Oct. 1989), 16 pages.

Ruze, J., "Antenna Tolerance Theory—A Review.", Proceedings of the IEEE, vol. 54, No. 4, pp. 633-640, (Apr. 1966).

Sauder, J. et al., "Ultra-Compact Ka-Band Parabolic Deployable Antenna for RADAR and Interplanetary CubeSats.", 29TH Annual AIAA/USU Conference on Small Satellites, Logan, UT, USA, (Aug. 2015), 4 pages.

Shirvante, V. et al., "Configuration of 3U CubeSat Structures for Gain Improvement of S-Band Antennas.", AIAA/USU Small Satellite Conf., (Aug. 2012), 18 pages.

Tibert, G., "Deployable Tensegrity Structures for Space Applications.", TRITA-MEK Technical Report 2002:04, ISSN: 0348-467X, ISRN KTH/MEK/TR—02—/04—SE, (2002), 244 pages.

Williams, D.W. et al., "High-Capacity Communications from Martian Distances—Chapter 5.", NASA Tech Report, NASA/TM-2007-214415, NASA Glenn Research Center, Cleveland, OH., (Mar. 2007), 163 pages.

Non-Final Office Action for U.S. Appl. No. 15/204,951, filed Jul. 7, 2016 on behalf of Richard Hodges. dated Sep. 14, 2017. 18 pages.

Non-Final Office Action for U.S. Appl. No. 15/204,951, filed Jul. 7, 2016 on behalf of California Institute of Technology. dated May 8, 2018. 21 pages.

PARABOLIC DEPLOYABLE ANTENNA

CROSS REFERENCE TO RELATED APPLICATIONS

The present application claims priority to U.S. Provisional Patent Application No. 62/168,118, filed on May 29, 2015, the disclosure of which is incorporated herein by reference in its entirety.

STATEMENT OF INTEREST

The invention described herein was made in the performance of work under a NASA contract NNN12AA01C, and is subject to the provisions of Public Law 96-517 (35 USC 202) in which the Contractor has elected to retain title.

TECHNICAL FIELD

The present disclosure relates to antennas. More particularly, it relates to a parabolic deployable antenna.

BRIEF DESCRIPTION OF DRAWINGS

The accompanying drawings, which are incorporated into and constitute a part of this specification, illustrate one or more embodiments of the present disclosure and, together with the description of example embodiments, serve to explain the principles and implementations of the disclosure.

SUMMARY

Figure 1:
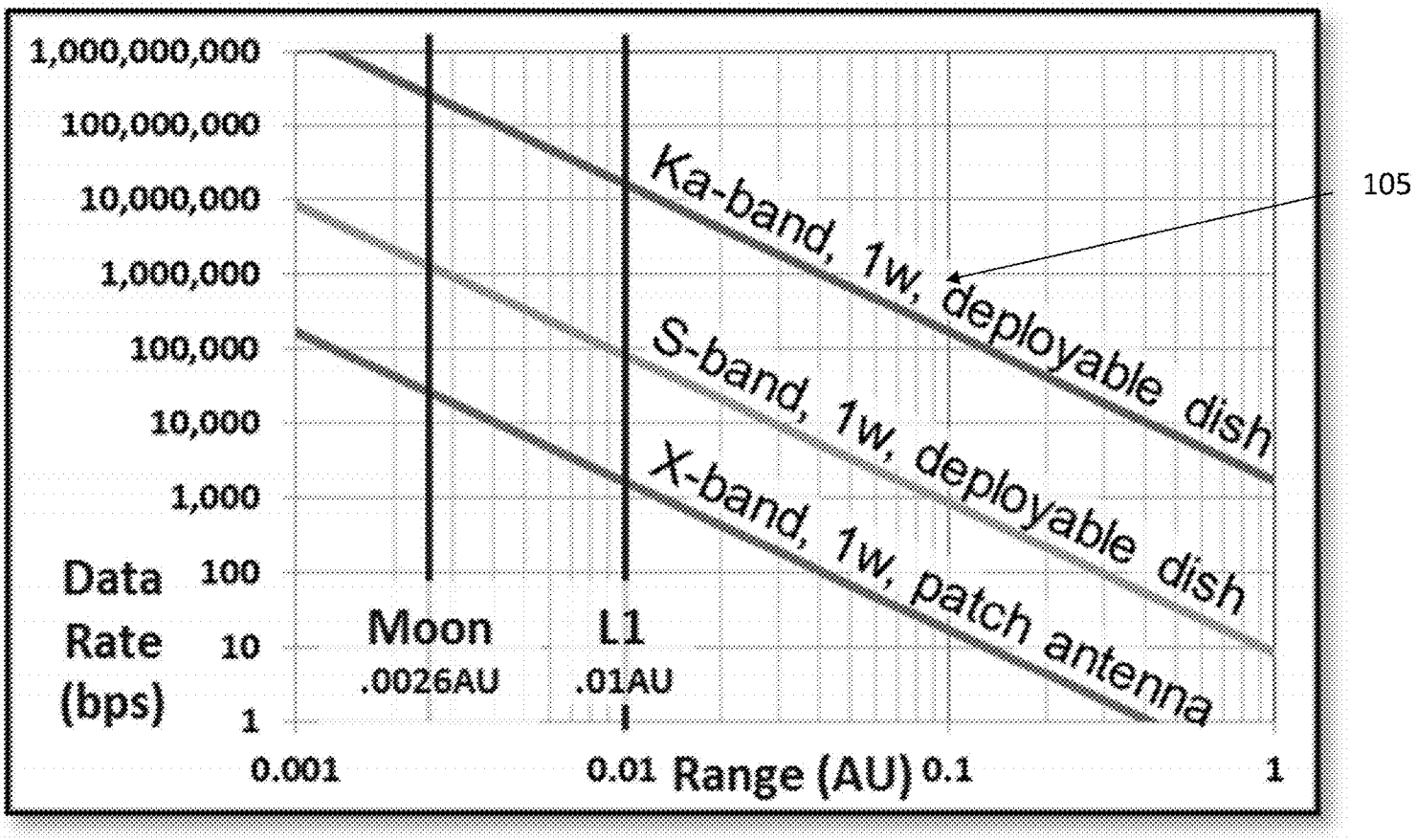
FIG. 1 illustrates data rates for different communication bands.

In a first aspect of the disclosure, a deployable antenna is described, the deployable antenna comprising: a cylindrical container; a deployment mechanism attached to the cylindrical container; a hub within the cylindrical container, configured to deploy along a longitudinal axis of the cylindrical container upon activation of the deployment mechanism; a plurality of root ribs attached to the hub and configured to rotate away from the longitudinal axis upon deployment; a plurality of tip ribs, each tip rib attached to a corresponding root rib by a rotating hinge, the plurality of tip ribs configured to rotate away from the longitudinal axis upon deployment; a mesh attached to the plurality of root and tip ribs; a horn attached to the hub, the horn extending along the longitudinal axis and located centrally to the mesh; and a sub-reflector attached to the horn and configured to extend away from the horn along the longitudinal axis upon deployment, wherein the mesh, horn, root ribs, tip ribs and sub-reflector are configured to operate between 2 and 50 GHz.

In a second aspect of the disclosure, a method is described, the method comprising: providing a deployable antenna, the deployable antenna comprising: a cylindrical container; a deployment mechanism attached to the cylindrical container; a hub within the cylindrical container, configured to deploy along a longitudinal axis of the cylindrical container upon activation of the deployment mechanism; a plurality of root ribs attached to the hub and configured to rotate away from the longitudinal axis upon deployment; a plurality of tip ribs, each tip rib attached to a corresponding root rib by a rotating hinge, the plurality of tip ribs configured to rotate away from the longitudinal axis upon deployment; a mesh attached to the plurality of root and tip ribs; a horn attached to the hub, the horn extending along the longitudinal axis and located centrally to the mesh; and a sub-reflector attached to the horn and configured to extend away from the horn along the longitudinal axis upon deployment, wherein the mesh, horn, root ribs, tip ribs and sub-reflector are configured to operate between 2 and 50 GHz; activating the deployment mechanism, thereby deploying the hub along a longitudinal axis of the cylindrical container; rotating the root and tip ribs away from the longitudinal axis; and extending the horn and sub-reflector along the longitudinal axis.

DETAILED DESCRIPTION

The present disclosure describes antennas that can stow in a limited space and reliably deploy for high gain operation in different bands. The antennas can be employed in different applications such as RADAR and telecommunication, and can be equipped to different vehicles such as small satellites and aerial vehicles. An example of a small satellite format is CubeSat. A CubeS at (U-class spacecraft) is a miniaturized satellite for space research that comprises one or more cubic units. For example, each cubic unit can be 10×10×11.35 cubic cm. CubeSats have a mass of no more than 1.33 kilograms per unit, and often use commercial off-the-shelf components for the internal electronics and structure. Their standardized dimensions allow efficient stacking and launching into space.

Cubesats provide the ability to conduct relatively inexpensive space missions. Over the past several years, technology and launch opportunities for Cubesats have greatly increased, enabling a wide variety of missions. However, as instruments become more complex and Cubesats travel deeper into space, data communication rates can become an issue. For example, FIG. 1 illustrates data rates for different ranges and for different communication bands. A Ka-band high gain antenna (105) could provide a 100× increase of data communications rates over the state-of the-art, allowing for high rate data from deep space or the use of data intensive instruments from low Earth objects (LEOs). As the person of ordinary skill in the art will understand, data rate is positively correlated with gain, which is in turn positively correlated with antenna diameter. The antenna diameter is critical for communication in different applications. For example, earth science application benefit from increased antenna diameter to achieve swatch width (the foot print of the antenna on the ground).

The present disclosure describes a Ka-band high gain antenna that is also a parabolic deployable antenna (PDA). While a handful of PDA concepts for CubeSats have been developed, they all operate at a lower S-band data rate. Perhaps the most robust of the current concepts, and the only one to have flown so far, is the University of Southern California's Information Science Institute's (USC/ISI) ANEAS PDA. The design for this concept uses a folding rib architecture where ribs deploy like an umbrella (see FIG. 2). A mesh between each rib (205) provides a reflective surface. A similar deployment architecture is employed for the Ka-band parabolic deployable antenna (KaPDA) described in the present disclosure. Although several example embodiments below will be discussed for a Ka-band, the person of ordinary skill in the art will understand that the antenna disclosed in the present application is not limited to the Ka-band, but could work at other bands as well. For example, the antennas could work at the S, W and X-bands, or at other frequencies. The antenna operation can be modified by changing the feed, as the feed determines the operational bandwidth. With the appropriate feed, the antenna can operate simultaneous at different bands, for example X and Ka-bands.

Past concepts for CubeSat PDA have included a spiral stowed rib design, see Ref. [7], a goer-wrap composite reflector, see Ref. [20], a reflector transformed from the CubeSat body, see Ref. [21], and a folding rib concept which was used in USC/ISI's APDA, see Ref. [5]. Many of these designs have issues with compacting to the required size, see Ref. [20], and surface rigidity, see Ref. [7], and all are only designed to operate at the S-band. Designing an antenna to operate at the Ka-band requires different RF equipment, much tighter tolerances and greater structural stiffness than the S-band antennas, and it is challenging to stow it in only 1.5 U. In order to accomplish the Ka-band requirements, innovations include the Cassegrainian dual reflector design with a horn, waveguide and telescoping sub-reflector, deeper ribs with precision hinges, and an inflating bladder and cables used to drive deployment.

As known to the person of ordinary skill in the art, the Ka band covers the frequencies of 26.5-40 GHz, that is wavelengths from over one centimeter down to 7.5 millimeters. The Ka band is part of the K band of the microwave band of the electromagnetic spectrum.

Figure 2:
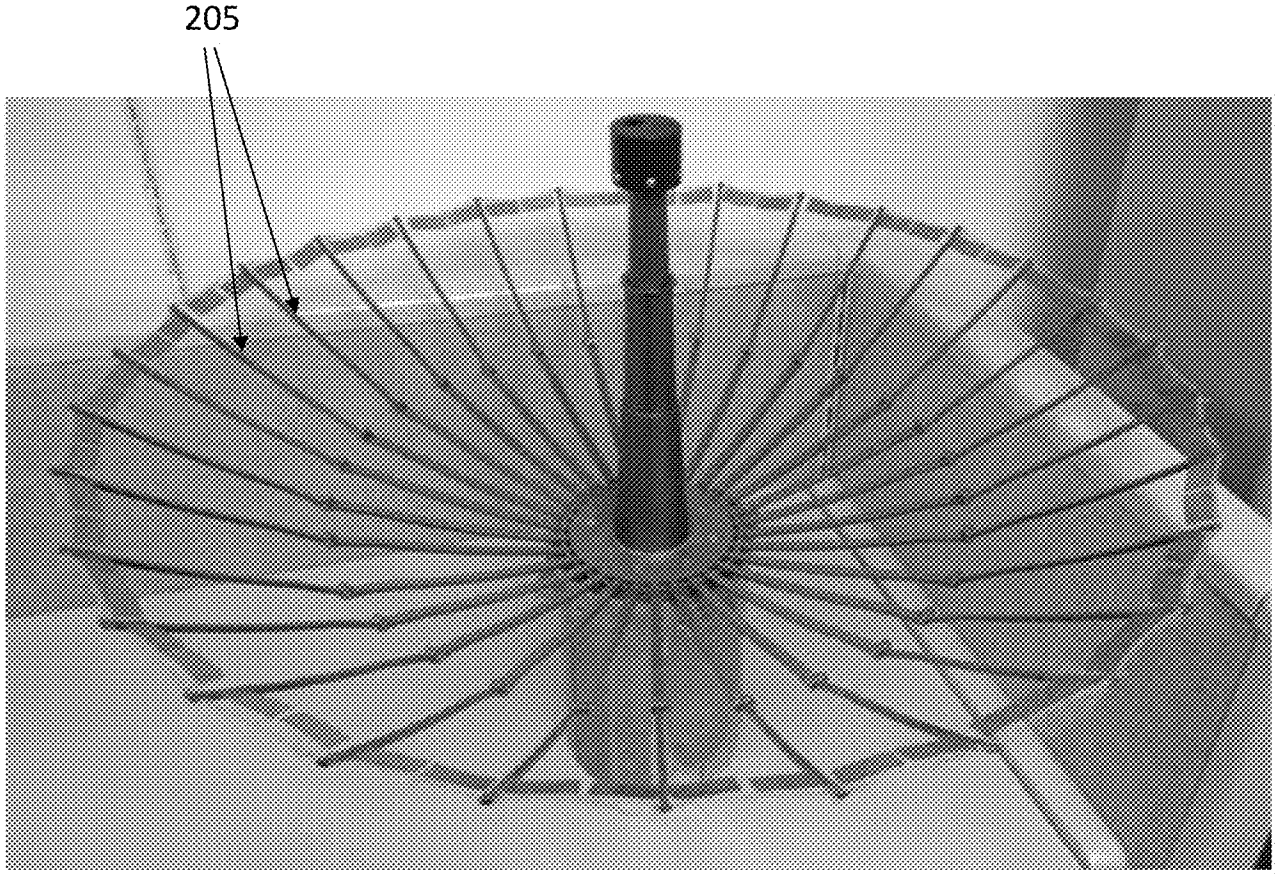
FIG. 2 (PRIOR ART)
FIG. 2 illustrates a prior art deployable antenna.
Figure 3:
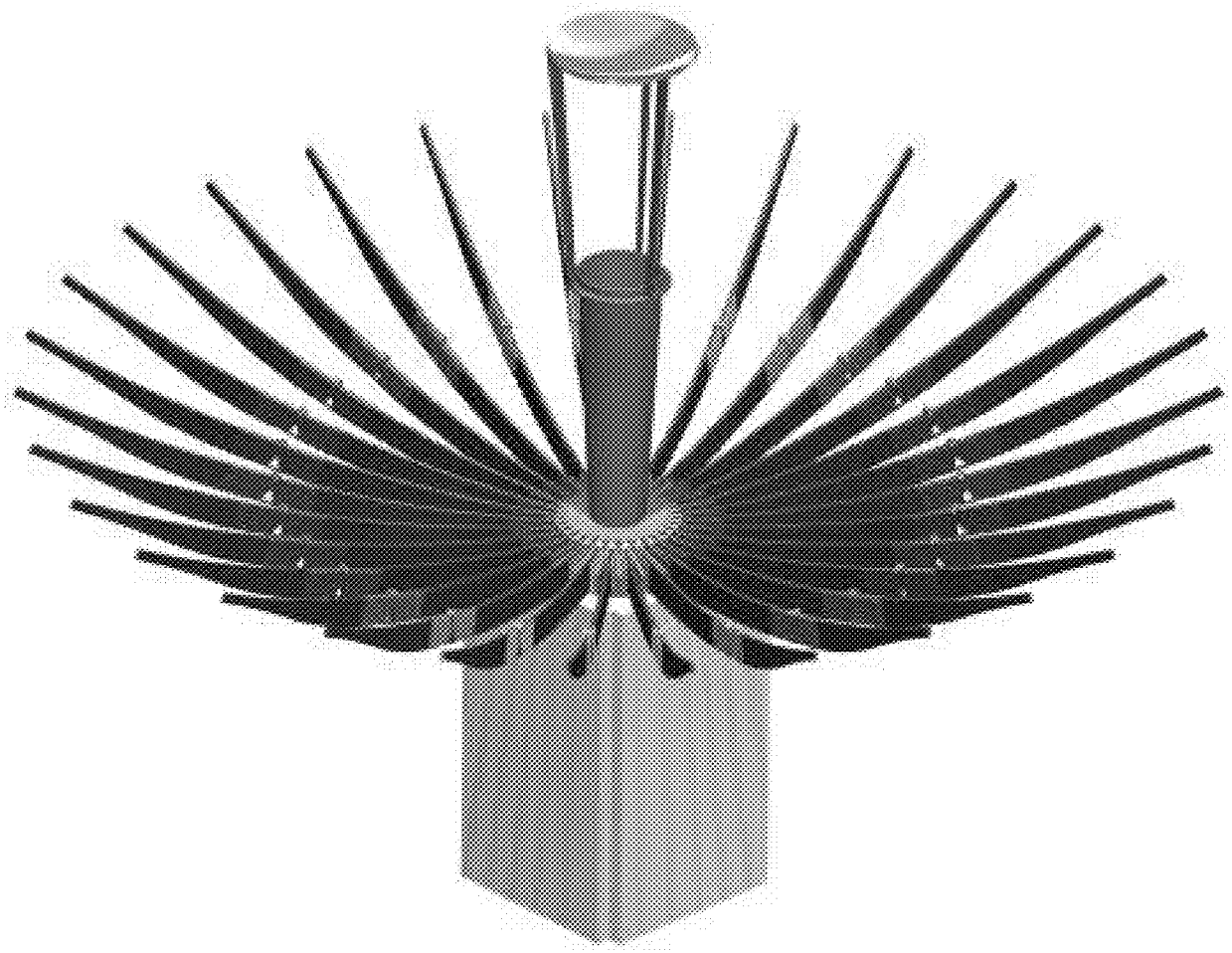
FIG. 3 illustrates embodiments of a deployable antenna according to the present disclosure.
Figure 4:
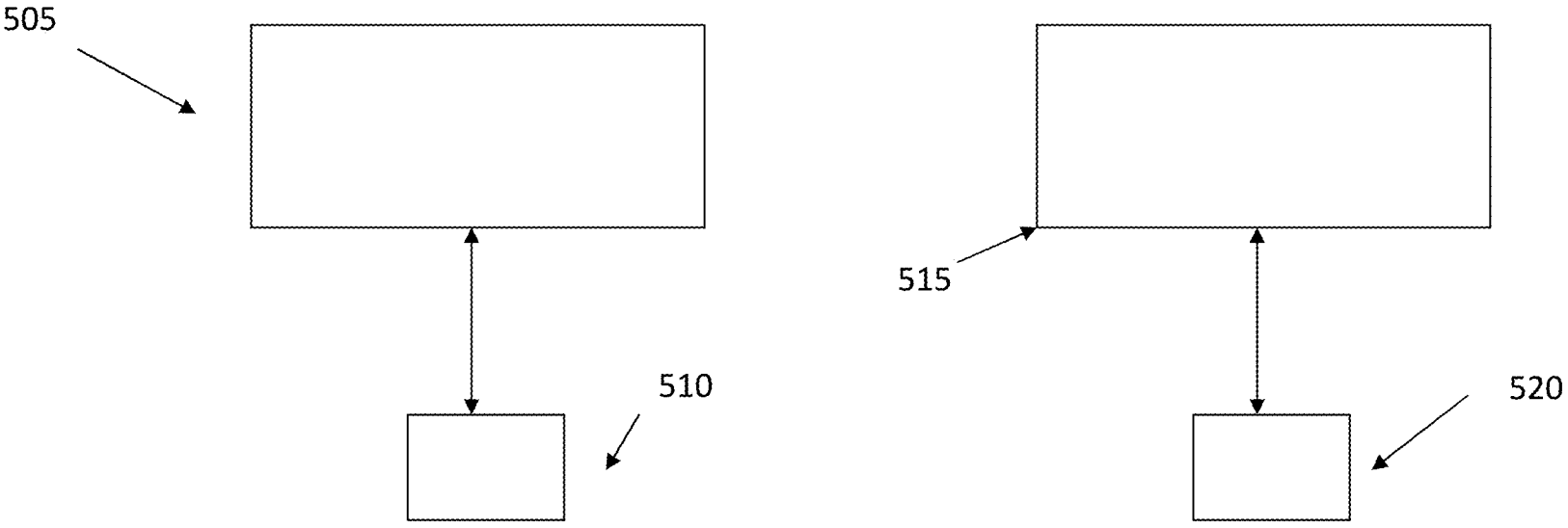
FIG. 4 illustrates how to modify the antenna operation for different bands.

For the KaPDA design, a folding rib architecture is used, similarly to that of FIG. 2, however the antenna was entirely redesigned (FIG. 3). A dual reflector Cassegrainian design was selected as it best balances RF gain and stowed size. The antenna, in some embodiments, is 0.5 meters in diameter and stows into 1.5 U (10×10×16.2 $cm^3$). In other embodiments, different dimensions may be used. For example, the antenna could stow in a 20×20×30 cubic cm for a 1 meter antenna. To hold the surface accuracy required by the Ka-band, the antenna was designed with deep ribs and precision hinges.

In some embodiments, the ribs of the antenna can be deployed by cables which are actuated by a slowly inflating bladder, and are then latched into place. Using a bladder reduces the whiplash which occurs in many other antenna designs where strain energy or springs are used for deployment. The sub reflector can be supported by a composite structure which telescopes along the horn during a spring powered deployment. The basic structural and RF geometry are shown in FIG. 3. RF simulations show that, in some embodiments, after losses, the antenna will have about 42 dB gain, at 50% efficiency.

KaPDA creates opportunities for a host of new Cubesat missions by allowing high data rate communication which enables using high fidelity instruments or venturing further into deep space, including interplanetary missions. Additionally, KaPDA provides a solution for other small antenna needs and the opportunity to obtain earth science data with CubeSats. For example a variant of KaPDA could be used to measure precipitation.

CubeSats are positioned to play a key role in Earth Science, wherein multiple copies of the same RADAR instrument are launched in desirable formations, allowing for the measurement of atmospheric processes over a short, evolutionary timescale. To achieve this goal, such CubeSats require a high gain antenna that fits in a highly constrained volume. As noted above, the present disclosure describes a mesh deployable Ka-band antenna design that folds in a 1.5 U (10×10×15 $cm^3$) stowage volume suitable, for example, for 6 U (10×22×36 $cm^3$) class CubeSats. Considering all aspects of the deployable mesh reflector antenna including the feed, detailed simulations and measurements show that 42.6 dBi gain and 52% aperture efficiency is achievable at 35.75 GHz. The mechanical deployment mechanism and associated challenges are also described, as they are important components of a deployable antenna. Both solid and mesh prototype antennas have been developed and measurement results show excellent agreement with simulations.

With the recent advances in miniaturized RADAR and CubeSat technologies, launching multiple copies of a RADAR instrument is now possible. The antennas described in the present disclosure can be used for space instruments (e.g. RADAR) and as part of telecommunication subsystem allowing high-data rate or long distance communication (i.e. Deep Space communications). Although several embodiments are discussed herein with reference to CubeS at, the person of ordinary skill in the art will understand that the antennas may be employed in any application where the stowable volume is important, such as other small satellite applications and unmanned aerial vehicles (UAVs). A significant remaining challenge is an antenna design that provides high gain (>42 dBi) and fits in a highly constrained volume (<1.5 U). The required antenna gain and limited stowage volume dictates utilization of a deployable antenna. Different deployable antenna technologies are currently under investigation for CubeSats, for example inflatable antennas, see Ref. [3], folded panel reflectarray antennas, see Ref. [4], and deployable mesh reflector antennas, see Refs. [5-7]. However, some of these deployable technologies have disadvantages. For example, inflatable antennas can have malfunction problems due to their gas systems, see Ref. [8]. Reflectarray/transmitarray antennas are lightweight, rather inexpensive and can be typically folded in panels to yield stowage efficiency. However, reflectarrays exhibit narrow bandwidth (<10% depending on element design and F/D as in Ref. [9]) and the maximum gain of current configurations is limited by the number of panels that can be practically folded into a CubeS at.

Reflector antennas are the most commonly used solutions for high gain spacecraft antennas, as they provide high efficiency, and can support any polarization. The reflector's large bandwidth allows for multiple frequency operation using a multi-band feed system. General reflector antenna design guidelines are known to the person of ordinary skill in the art, see Refs. [12-13]. However, all deployable reflectors flown to date have been developed for large spacecraft that afford greater space within the launch shroud, which allows for spacecraft packaging to be adapted to accommodate antenna stowage, see Refs. [12-19]. Consequently, existing antenna designs do not address the requirement to fit within the rigid CubeSat packaging constraints. Furthermore, existing mesh reflector designs cannot be directly scaled to CubeS at dimensions because knitted mesh density and thickness are fixed by RF requirements and other deployment mechanism devices such as springs, hinges and motors are not directly scalable. The present disclosure describes how to effectively address the unique RF, mechanical and packaging requirements for a CubeS at antenna.

There are a number of existing mechanical concepts to stow a deployable parabolic antenna in a CubeSat, but all were designed for S-band operation. Furthermore, some antenna designs operating a the S-band are not scalable to the Ka-band, due to surface accuracy limitations and the prime focus feed configuration (which leads to excessive blockage loss and feed loss). For example, a wrap-rib style antenna with mesh attached to ribs wrapped around a center hub, see Ref. [24], has also been fabricated. However, using thin, flexible ribs (required to enable the design to wrap around the small CubeS at hub) would not provide adequate rigidity to tension the mesh, as the ribs would be too flexible to hold the mesh in place when deployed.

Other issues with current technologies are described in the following. Solid deploying reflectors have great surface accuracy, but do not stow well in small spaces and can be heavy (e.g. Hughes spring-back antenna). Shape memory reflectors may work at lower frequencies, but much development is still required as at Ka-band the surface is not accurate enough. Inflatable reflectors stow well and are lightweight but have issues with maintaining inflation and shape. This is especially problematic on interplanetary CubeSat missions which will likely last much longer than LEO CubeSat missions. Reflectarray antennas provide a relatively high gain and stow well in large flat spaces (i.e. areas for solar panels on a CubeSat), but have very limited operational frequency range, thus requiring two separate antennas, one to transmit and the other to receive. Therefore, the most attractive design for a Ka-band parabolic deployable antenna is a mesh antenna, which balances surface accuracy, longevity, and mass.

Figure 5:
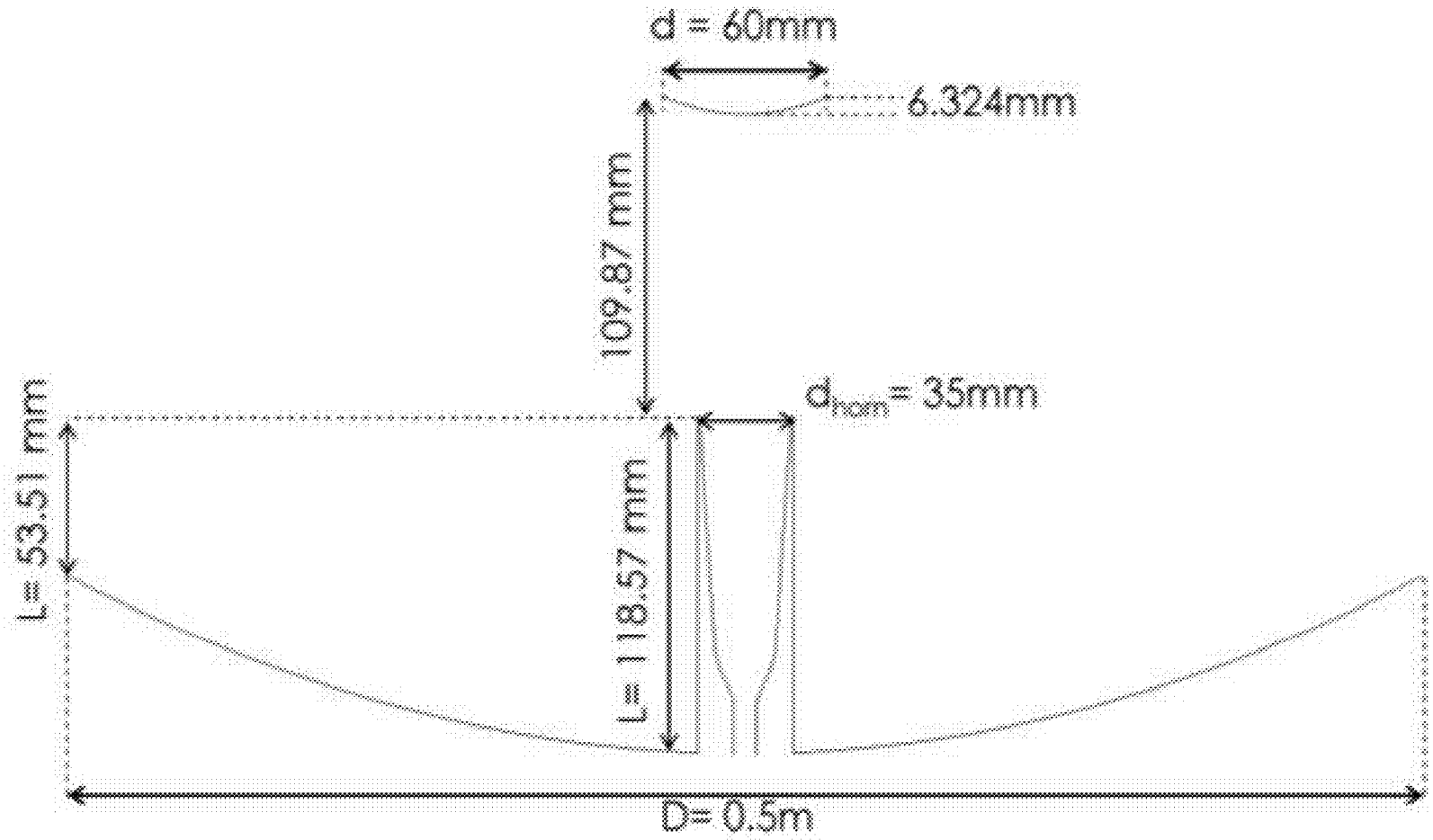
FIG. 5 illustrates an optimized Cassegrain reflector antenna design.

As mentioned above in the present disclosure, antennas operating at the Ka-band are disclosed. However, the antennas can be modified to operate at other bands by changing the feed system. For example, FIG. 5 illustrates how an antenna (505) operating at the Ka-band with a first feed (510) can be modified to operate at a different band by connecting the antenna (515) to a second feed (520) operating in a second band.

The present disclosure describes the first deployable mesh reflector antenna concept for CubeSats operating at the Ka-band where volume and weight constraints are driving the electromagnetic and mechanical choices. The present disclosure pave the way for future utilization of CubeSat antennas that will revolutionize future space and Earth observations, as well as space explorations.

In some embodiments, the reflector antenna is optimized at 35.75 GHz over the desired narrow bandwidth of 20 MHz. To minimize the complexity of the mechanical deployment, an axially symmetrical reflector antenna was selected. Cassegrain reflectors, Gregorian reflectors, and splash plate configurations were identified as possible candidates for CubeSat deployable antennas. Two main constraints are set by the mechanical deployment. First, the F/D ratio (where F is the focal length and D the reflector diameter) is determined by the need to minimize the rib curvature so that the ribs fit within the volume between the subreflector/horn deployment mechanism and the walls of the CubeSat. A minimum F/D ratio of 0.5 is determined for a 0.5 m reflector. Further, the height of the subreflector is directly influenced by the height of the stowed volume and the number of deployment mechanisms required to deploy the subreflector. To constrain the design to only one feed deployment mechanism, in some embodiments the subreflector has to be at a maximum distance of 22 cm above the vertex.

A Cassegrainian design was selected, in some embodiments, to accommodate the mechanical deployment mechanism constraints. For a 0.5 m reflector with a focal length of 0.25 m, a Gregorian and splash plate reflector cannot be used since the subreflector is forward of the focal point. In contrast, Cassegrain reflector optics place the subreflector aft of the focal point, which places the subreflector within the required 22 cm space above the vertex.

The Ka-band deployable mesh reflector antenna consists of four main elements: the feed, three struts, a hyperbolic subreflector, and a 0.5 m deployable parabolic mesh reflector, see FIG. 3. The focal length can be set at the minimum required 0.5 F/D ratio, or 0.25 m, in order to minimize the subreflector diameter and achieve the smallest blockage and lowest sidelobe performance. The maximum possible directivity $D_{max}(\pi \cdot D/\lambda)^2$ of the 0.5 m antenna is 45.45 dBi at 35.75 GHz. In other embodiments, the reflector may have a different diameter, for example 1 m instead of 0.5 m.

Figure 6:
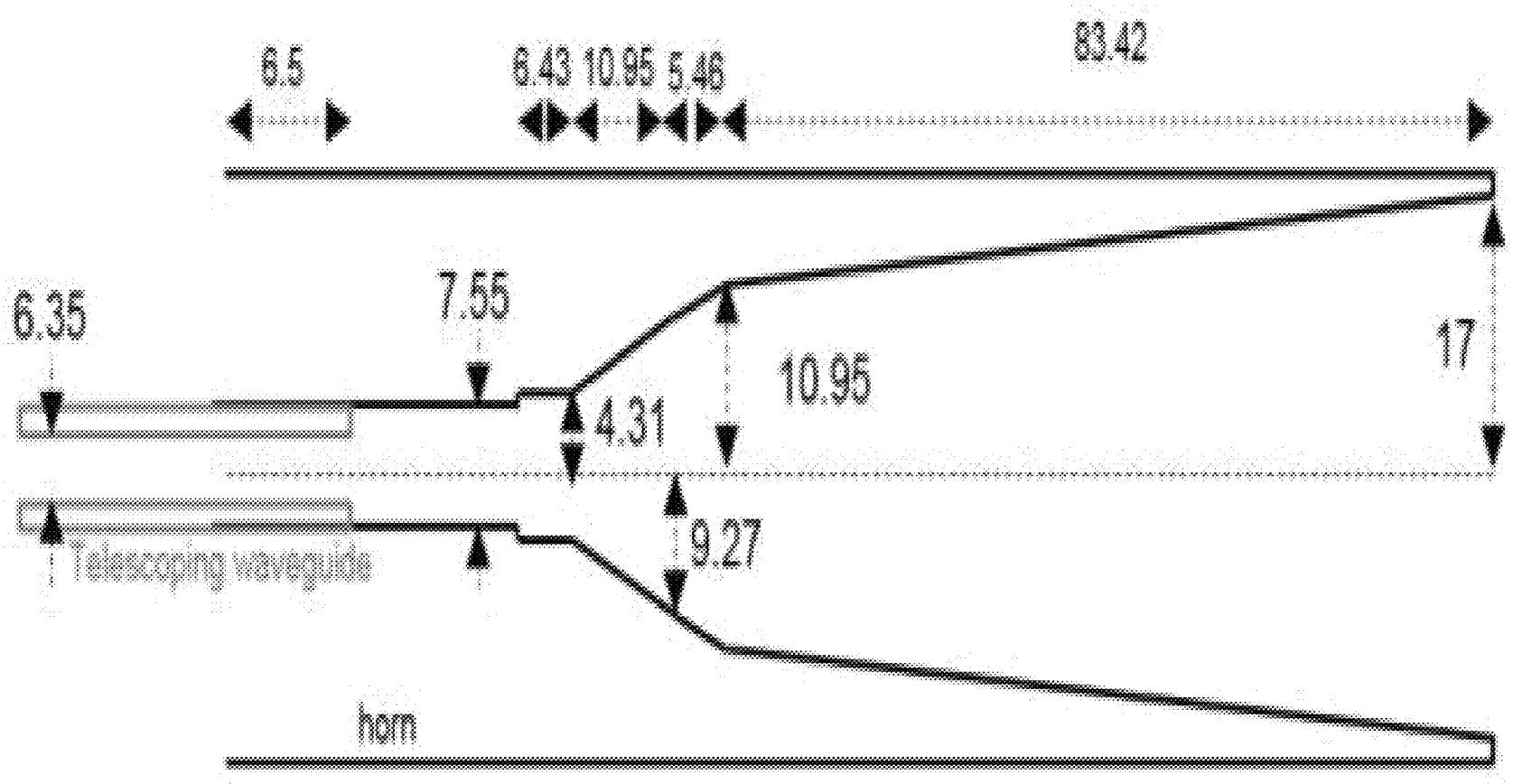
FIGS. 6-7 illustrate a multiflare horn antenna feed design.

The antenna can be first optimized with an ideal parabolic reflector surface with no ribs or surface distortion. This process allows assessing and minimizing the following losses: taper, spillover, and subreflector blockage. The subreflector position and dimensions (FIG. 5) were optimized to maximize the gain and minimize the sidelobe levels using TICRA CHAMP, a Mode Matching and Body-of-Revolution Method of Moment (BoR MoM) based analysis. The simulation includes a model of the multiflare horn feed shown in FIG. 6. In FIG. 6 the dimensions are in mm.

Figure 8:
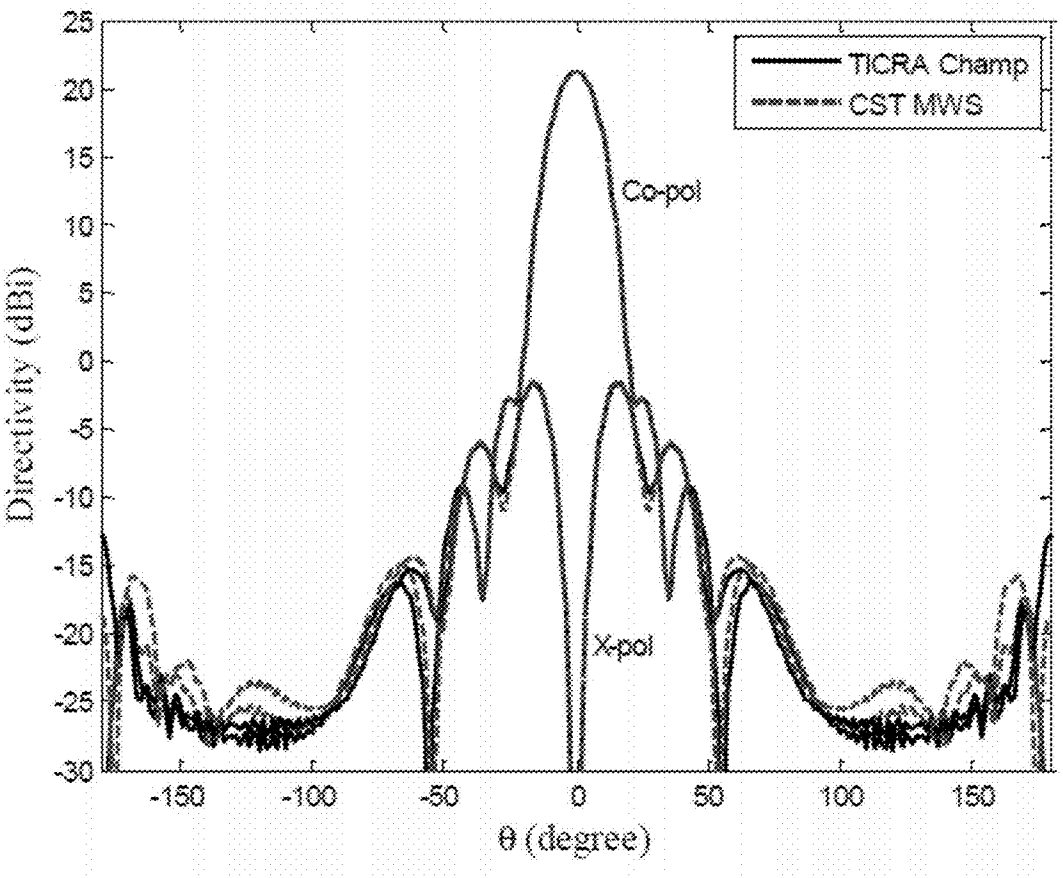
FIG. 8 illustrates a radiation pattern of the optimized multiflare horn feed.

The multiflare horn provides good beam circularity, stable feed taper, and low cross-polarization, see Ref. [28]. In order to minimize the taper and spillover losses, the feed can be optimized to provide a minimum feed taper of −10 dB at 15.5° (FIG. 8). FIG. 8 illustrates a radiation pattern of the optimized multiflare horn feed providing a −10 dB taper at $\theta$=15.5° at 35.75 GHz. The radiation pattern is provided for $\varphi$=45°.

Figure 7:
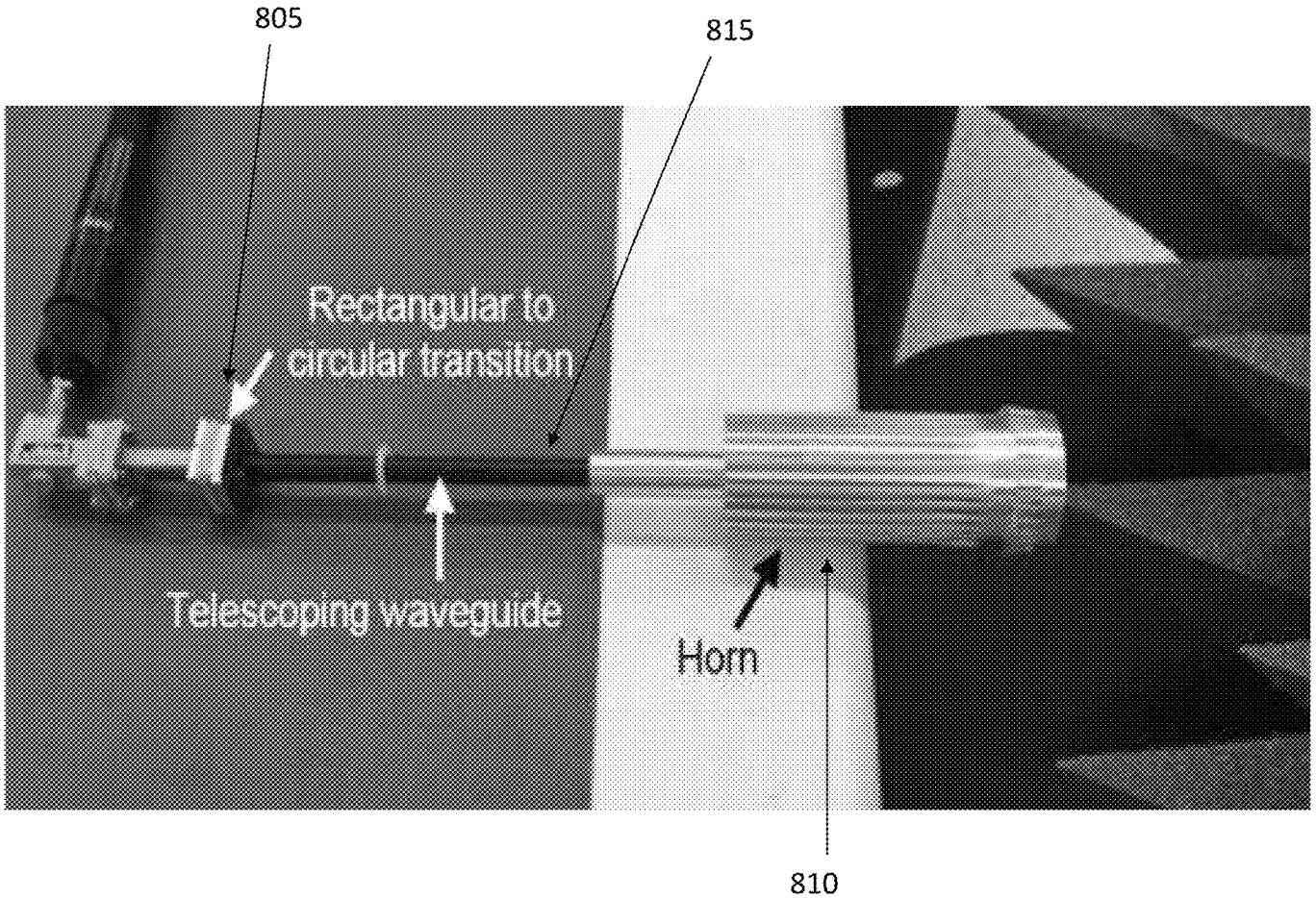

The horn is fed by a telescoping waveguide. When stowed, the telescoping waveguide fits inside the horn. During deployment, the horn slides upward while the telescoping waveguide does not move. A rectangular-to-circular waveguide transition, connected to the telescoping waveguide, is optimized to excite the feed with linear polarization. In FIG. 7, a picture of the horn (810), telescoping waveguide (815), and transition (805) is shown in FIG. 7.

Figure 9:
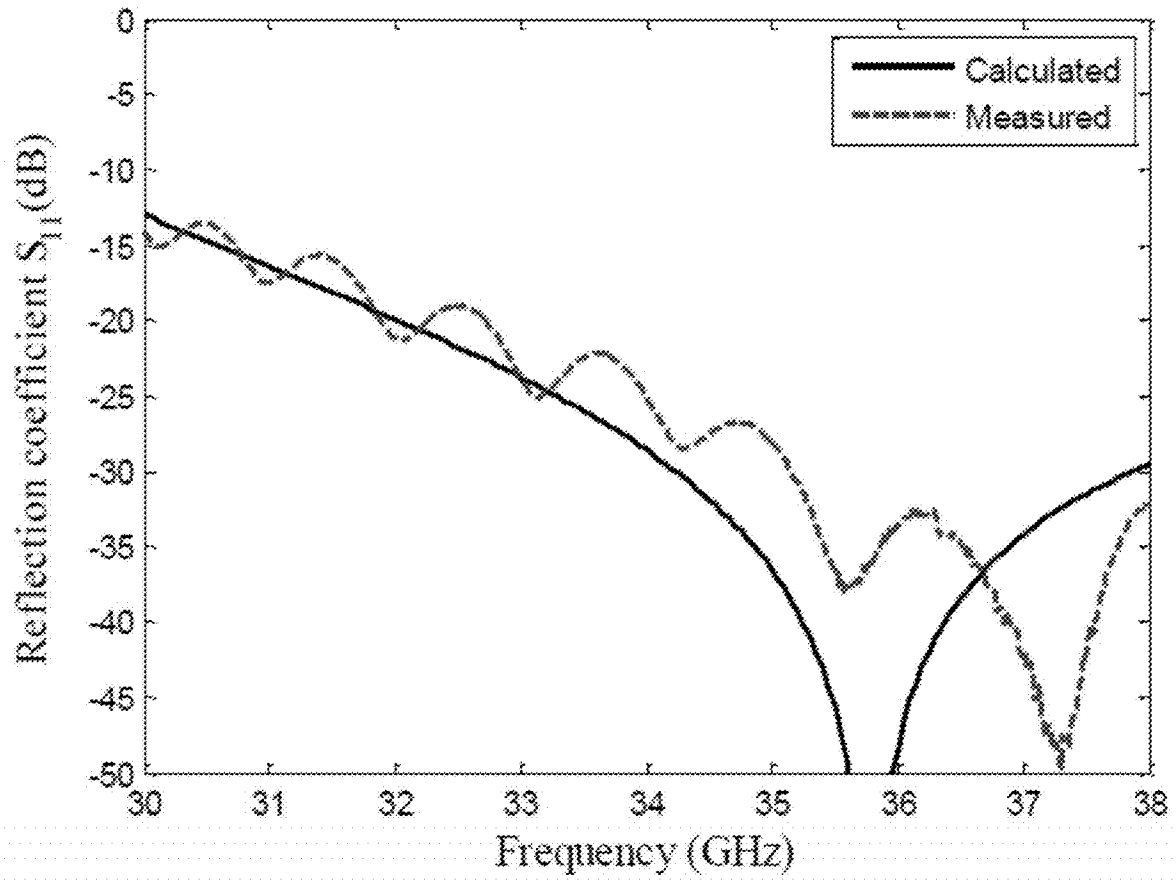
FIG. 9 illustrates data for rectangular-to-circular waveguide transition.

The rectangular-to-circular transition (805) consists of a stepped matching section that was designed by numerical optimization using CST MWS. Its overall length is 3.65 mm. The calculated and measured reflection coefficients are in good agreement as shown in FIG. 9 and achieves better than 30 dB over the 20 MHz radar band. FIG. 9 illustrates data for a rectangular-to-circular waveguide transition. The total length is 3.65 mm, which is important for packaging constraints. The measured isolation is below −30 dB.

Figure 10:
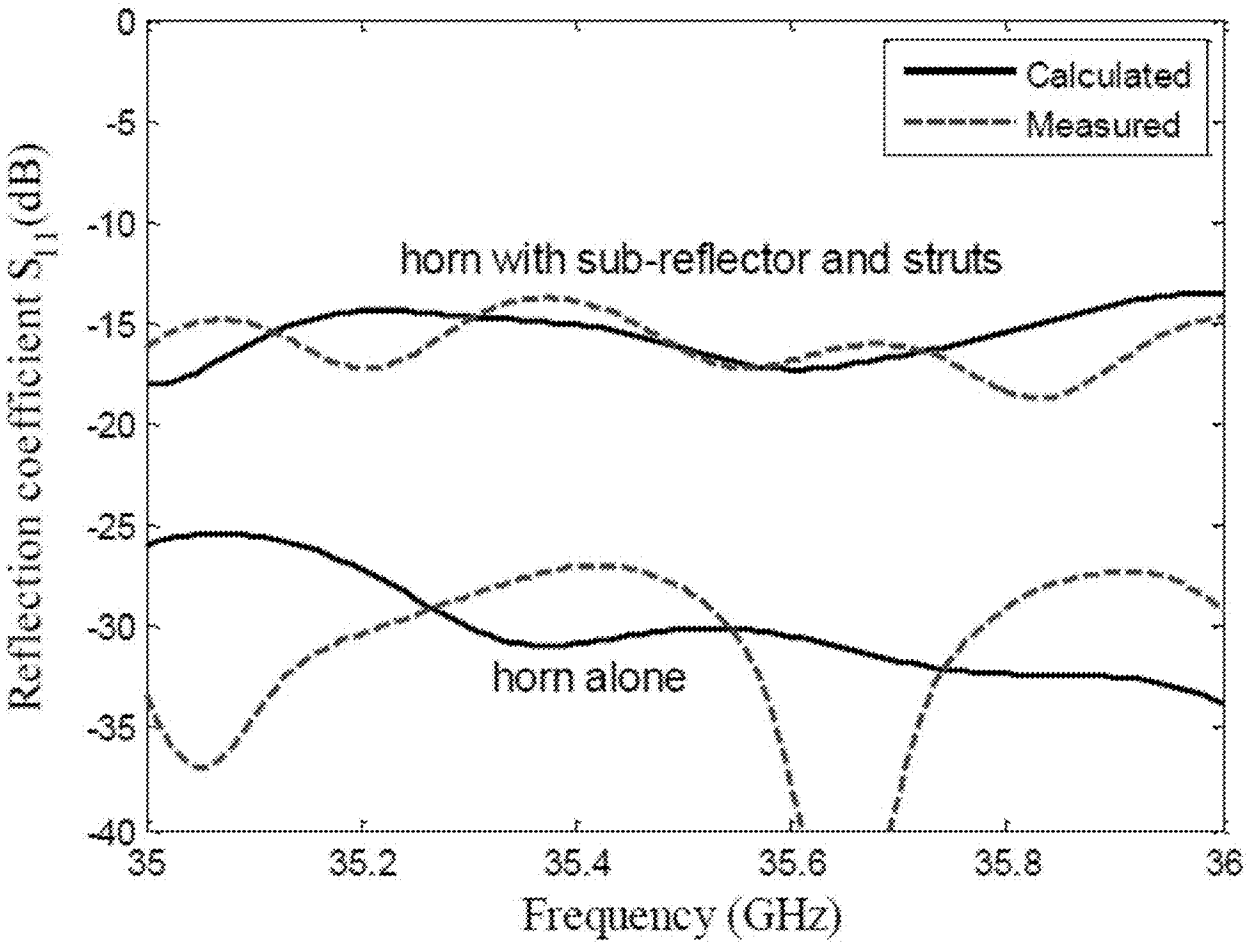
FIG. 10 illustrates a reflection coefficient of the feed-horn alone (including the telescoping waveguide and transition), with the struts and subreflector.

The horn performance was measured when connected to its telescoping waveguide and transition as shown in FIG. 7. The measured and simulated reflection coefficients of the horn assembly are in excellent agreement as shown in FIG. 10. FIG. 10 illustrates a reflection coefficient of the feed-horn alone (including the telescoping waveguide and transition), with the struts and subreflector.

With regard to an ideal reflector, an overall efficiency $\eta=\eta_T \cdot \eta_S$ can ideally reach up to 81% (i.e. −0.9 dB, where $\eta_T$ and $\eta_S$ are the taper efficiency and spillover efficiency, respectively), see Ref. [28]. The subreflector dimensions are the following: diameter $d_{sub}$ of 60 mm, vertex distance of 80 mm, and foci distance of 130.2 mm. Its diameter roughly represents 0.12 times the reflector diameter.

Figure 11:
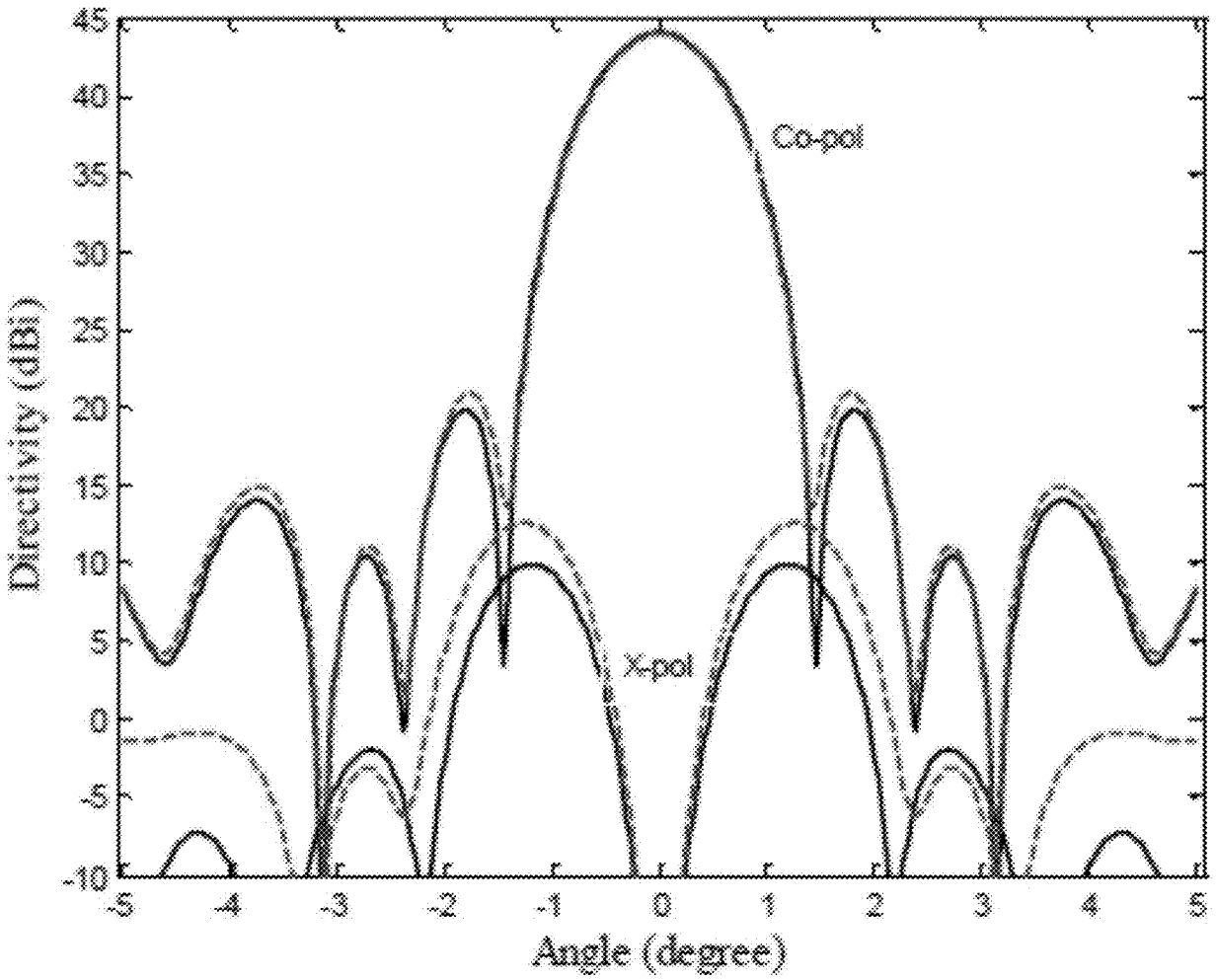
FIG. 11 illustrates a radiation pattern of the ideal parabolic reflector at 35.75 GHz and at $\varphi=45°$.

The spillover, taper, and blockage loss calculated at 35.75 GHz are summarized in Table I. The taper and spillover losses are about 1.15 dB. The subreflector blockage equals to 0.33 dB, which is in agreement with the 0.30 dB analytically calculated in Ref. [28]. Subtracting these losses from the 45.45 dBi area gain gives an optimized directivity of 43.97 dBi for the ideal Cassegrain reflector. The directivity calculated using CHAMP (BoR MoM) and GRASP (Physical Optics, PO) is 43.91 dBi and 43.97 dBi, respectively. The radiation patterns obtained using CHAMP and GRASP are in excellent agreement (FIG. 11). The difference between these two simulation results is due to the multiple reflections between the subreflector and the horn feed that are only included in CHAMP.

Table I details data for the gain at 35.75 Ghz after compensation (30 ribs).

TABLE I

| | Gain (dBi) | Loss (dB) | Peak SLL (dB) |
|---|---|---|---|
| Ideal directivity | 45.45 | — | — |
| Spillover + Taper | 44.3 | 1.15 | 23.1 |
| Blockage | 43.97 | 0.33 | 22.1 |
| Surface ribs (30) | 43.90 | 0.07 | 20.7 |
| Struts | 43.60 | 0.3 | 17.7 |
| Surface mesh* (40 OPI) | 43.35 | 0.25 | 17.4 |
| Surface accuracy** (±0.22 mm) | 42.88 | 0.47 | 16.8 |
| Feed loss/telescoping waveguide/transition | 42.76 | 0.12 | — |
| Feed mismatch (RL = 15 dB) | 42.62 | 0.14 | — |
| Overall performance | 42.62 | 2.83 | 16.8 |

In Table I, *refers to values based on calculated results using GRASP model of a 40 OPI mesh, while **is calculated using Ruze's equation, see Refs. [26-27]. The surface accuracy was adjusted with the measured number of ± 0.22 mm.

The antenna gain and loss contributions are assessed thoroughly and are summarized in Table I for the deployable antenna. The losses include taper, spillover, blockage from the subreflector, ribs, struts blockage and diffraction, surface mesh, surface accuracy, feed loss, and feed mismatch.

Figure 12:
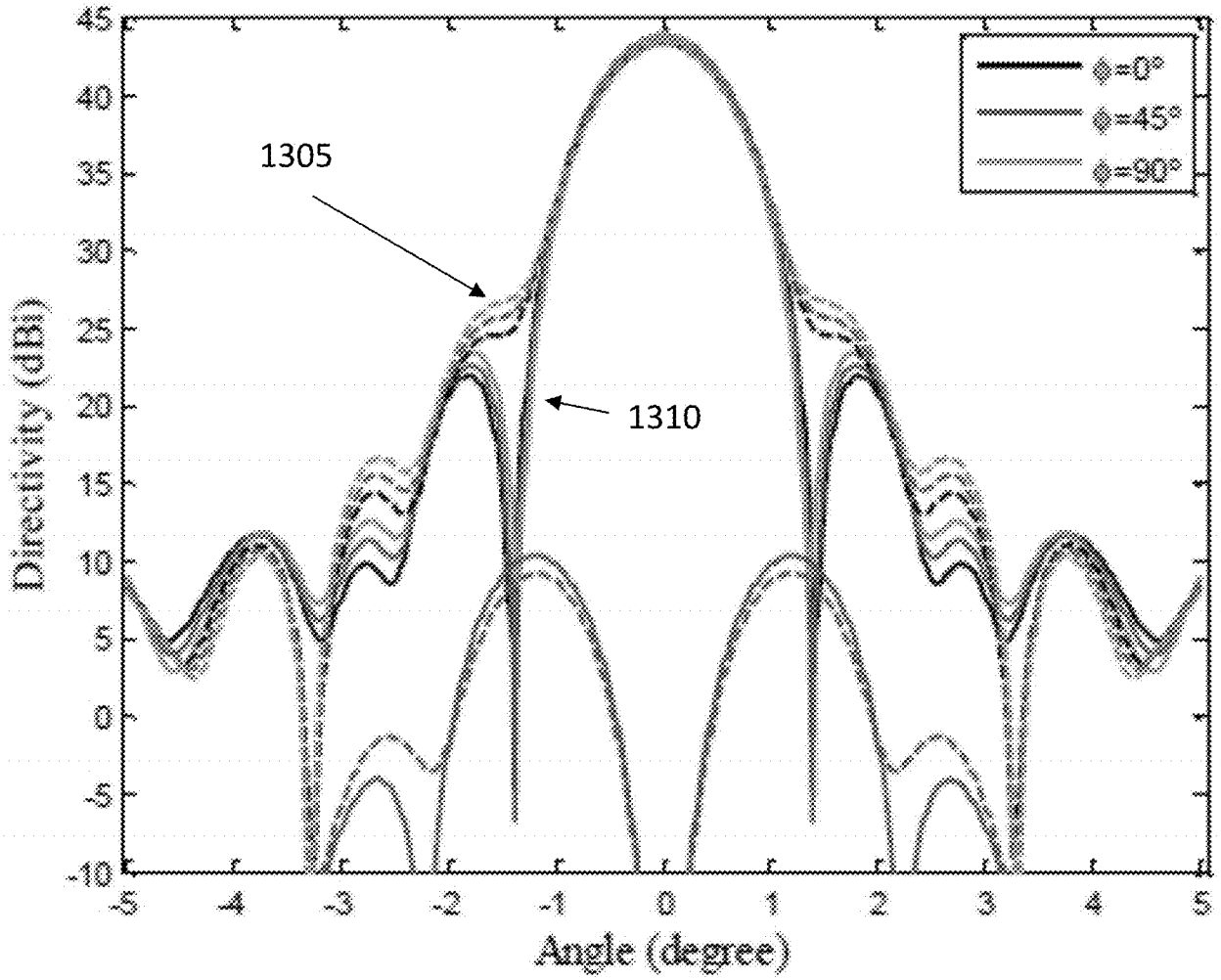
FIG. 12 illustrates the de-focusing effect using 30 ribs.

In practice, the deployable antenna is an unfurlable mesh reflector with 30 ribs (i.e. umbrella shaped). The number of ribs is a tradeoff between good RF performance, limited available stowage volume, and mitigation of the risk of deployment failure. When the supporting ribs of the quasi-parabolic reflector are parabolic in shape and the surface between any two adjacent ribs is the surface of a parabolic cylinder, the deviation of the surface from the true parabolic cylinder has the effect of spreading the focal point of the parabolic reflector into a focal region, see Ref. [29]. Therefore, the focal distance of the unfurlable reflector $F_{ribs}$ needs to be re-optimized for the 30 rib configuration. After re-optimization of the subreflector position, the loss caused by the 30 section rib-and-gore surfaces is only 0.07 dB. It is worthwhile to emphasize that without re-optimization, the loss is equal to 0.5 dB at 35.75 GHz (see FIG. 12). In FIG. 12, the subreflector is re-focused to compensate the ribs effect. Line (1305) refers to values before correction, while line (1310) refers to values after correction. $Gain_{re\text{-}focused}$=43.9 dBi, $Gain_{de\text{-}focused}$=43.4 dBi.

The equivalent gore surface RMS error calculated using Ruze's equation is about 0.23 mm, see Ref. [26]. The radiation pattern before and after re-optimizing the subreflector position is shown in FIG. 12, which illustrates a clear improvement.

Figure 13:
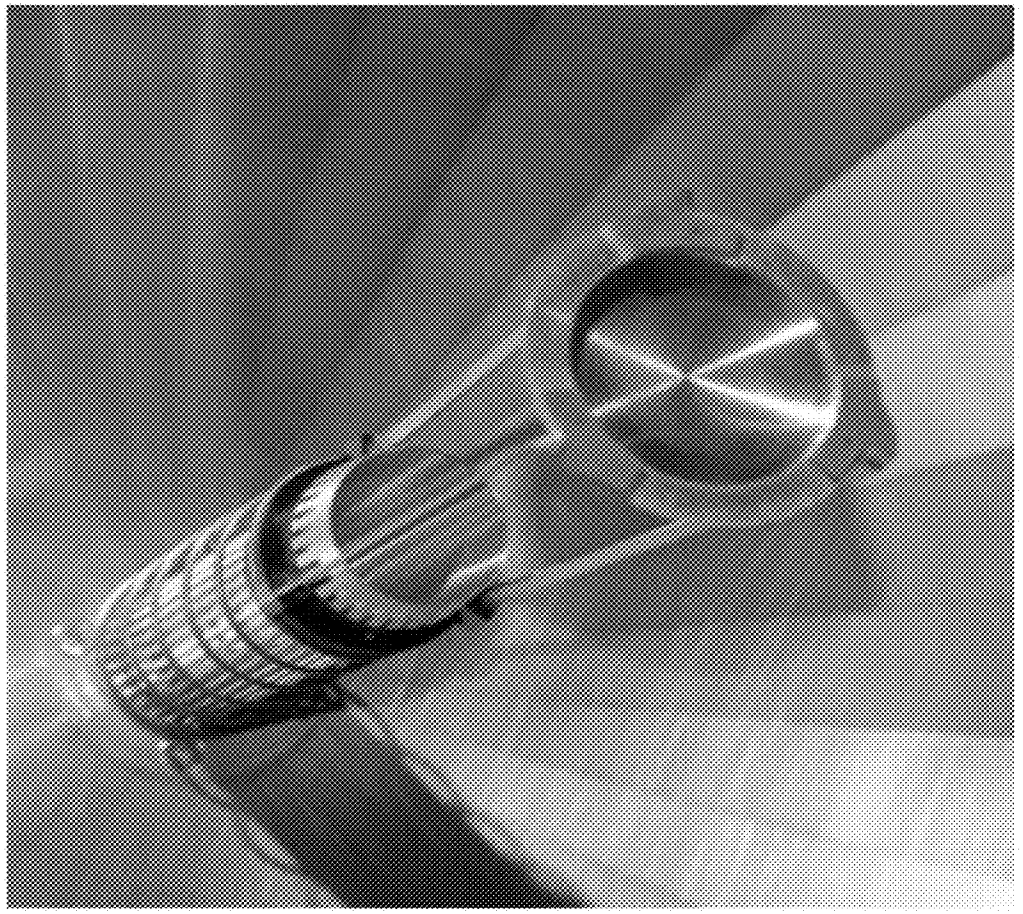
FIG. 13 illustrates a horn with three struts.

The reflection coefficient of the horn is shown in FIG. 10 with the subreflector (after re-optimization of the subreflector position). Simulated and measured results are in good agreement. Although the effect of the struts is negligible, the effect of the multiple reflections between the horn and the subreflector is rather significant. The ripples observed in the presence of the struts and subreflector is mainly due to the subreflector. Depending on the application, the reflection coefficient might need to be improved and a different methodology could be employed (e.g. reshaping of the subreflector as in Ref. [30]). To maintain a good alignment of the subreflector, three stainless steel struts can be employed as support, as illustrated for example in FIG. 13. In other embodiments, a different number of struts may be used. The presence of the struts affects the peak gain, the cross-polarization and the sidelobe levels. In some embodiments, the three rectangular cross-section struts are 1.0 mm thick and 4.0 mm deep. The struts result in an overall increase in sidelobe level (~3 dB), reduce the peak gain (~0.3 dB at 35.75 GHz) as can also be seen from Table I, and must be under 1.0 mm wide to avoid further losses.

The deployable antenna described in the present disclosure uses, in some embodiments, a 40 openings-per-inch (OPI) mesh knitted from 0.0008" diameter gold plated Tungsten wire. The 40 OPI mesh provides excellent electrical performance but it can be stiffer and more difficult to tension accurately with the deployment mechanism than a less dense mesh (e.g. 30 OPI). The losses have been numerically assessed using GRASP and they equal 0.25 dB. In other embodiments, a different OPI mesh may be used, for example with 20, 30 or 50 OPI.

For a surface RMS of 0.2 mm, Ruze's equation predicts a 0.39 dB loss, see Ref. [26]. In order to maintain the required 0.2 mm RMS surface accuracy, an inflation driven deployment is employed as it applies more force than springs, which enables tight stretching of the mesh, pulling out wrinkles or other deformations from the stowing process. Additionally, the deployed rib positions are held in place by keeping all hinges pre-loaded against precision stops, ensuring the rib deploys consistently to the same position. Manufacturing errors during the machining process are eliminated by assembling the ribs on precision bonding fixtures, which greatly reduces inaccuracy caused by any component tolerance deviations.

Figure 14:
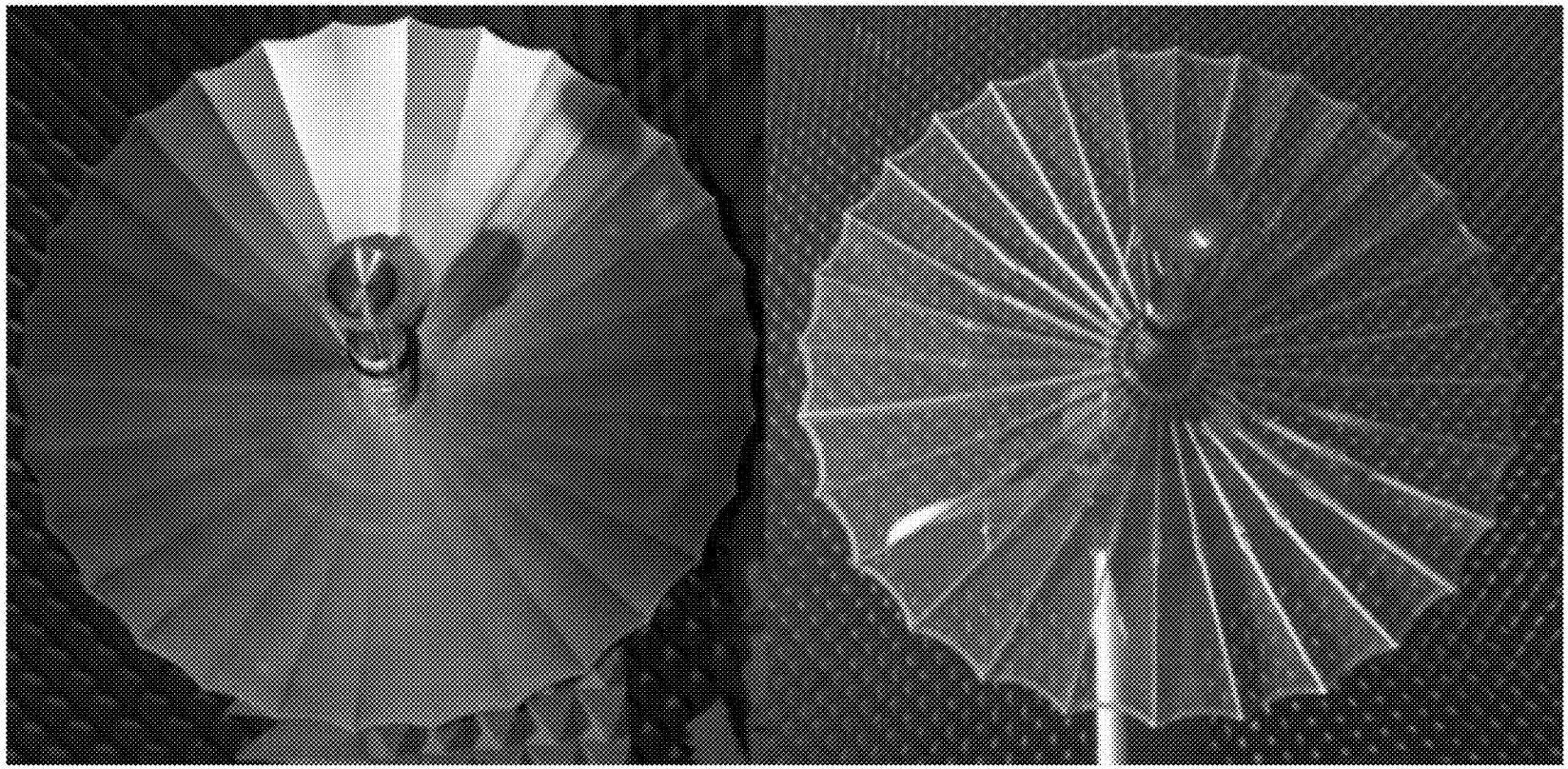
FIG. 14 illustrates antenna prototypes.
Figure 15:
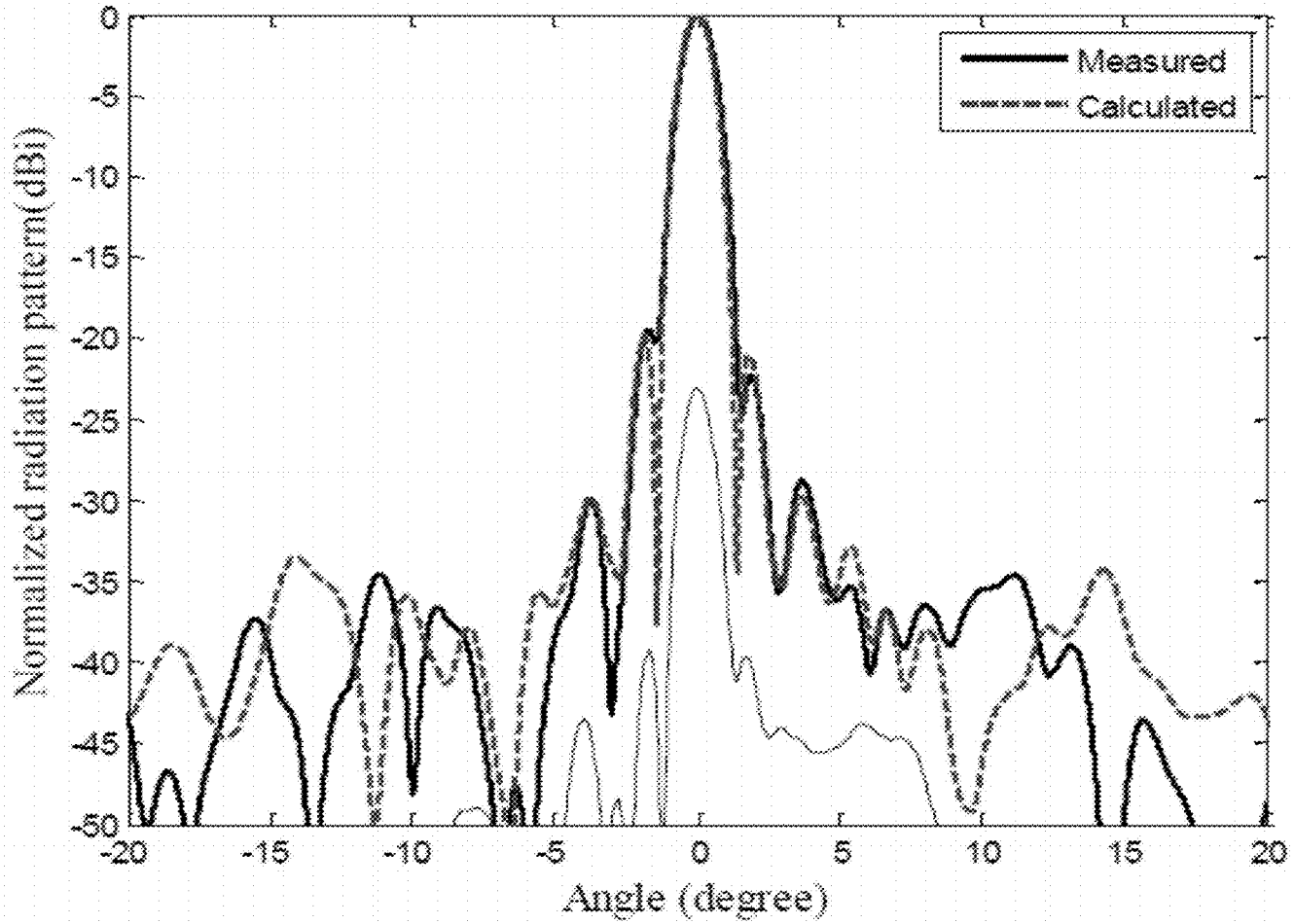
FIGS. 15-16 illustrate the measured and calculated radiation pattern of a gore-shaped solid non-deployable reflector antenna model.

Two different prototypes are illustrated in FIG. 14: a solid non-deploying RF prototype, which was used to validate the RF design (1505), and a mechanically deploying mesh prototype (1510). The solid reflector, representing the gore-mesh reflector surface, and the deployable mesh reflector were tested in a planar near-field antenna measurement facility at NASA's Jet Propulsion Laboratory. A gain comparison between the mesh deployable antenna and the non-deploying RF prototype can allow to precisely assess the losses due to the mesh opening and surface accuracy.

Figure 16:
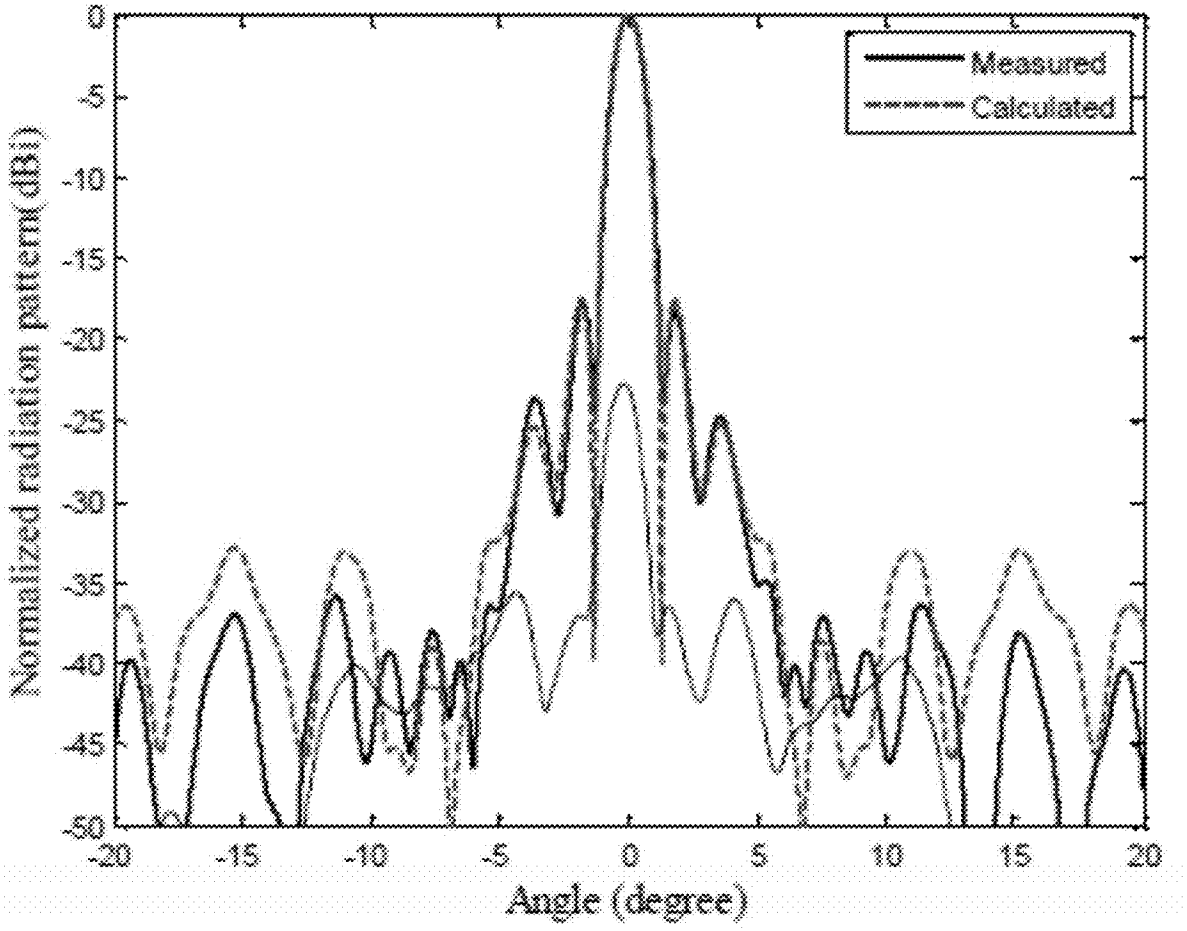
Figure 17:
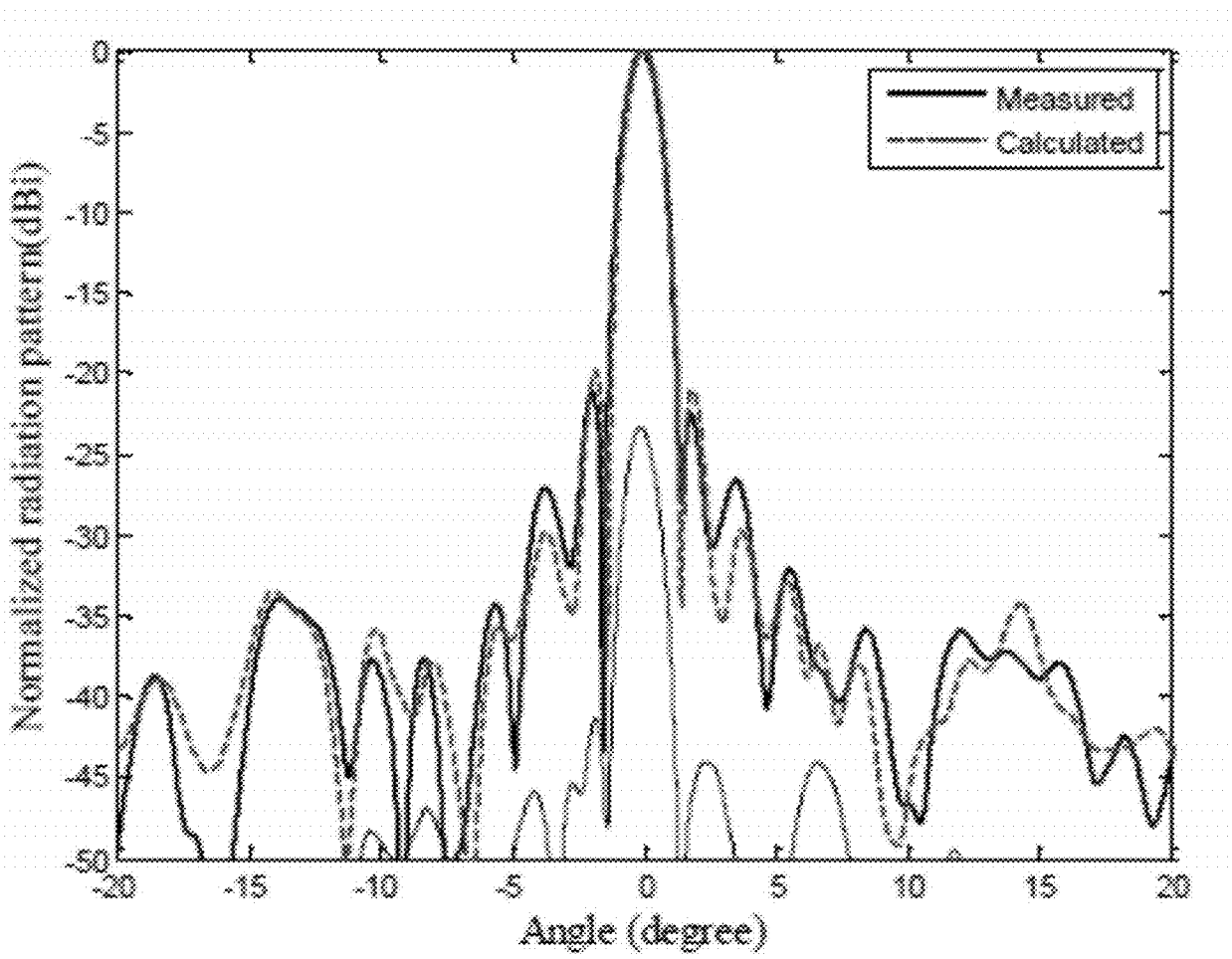
FIGS. 17-18 illustrate the measured and calculated radiation pattern of a deployable mesh reflector antenna model.
Figure 18:
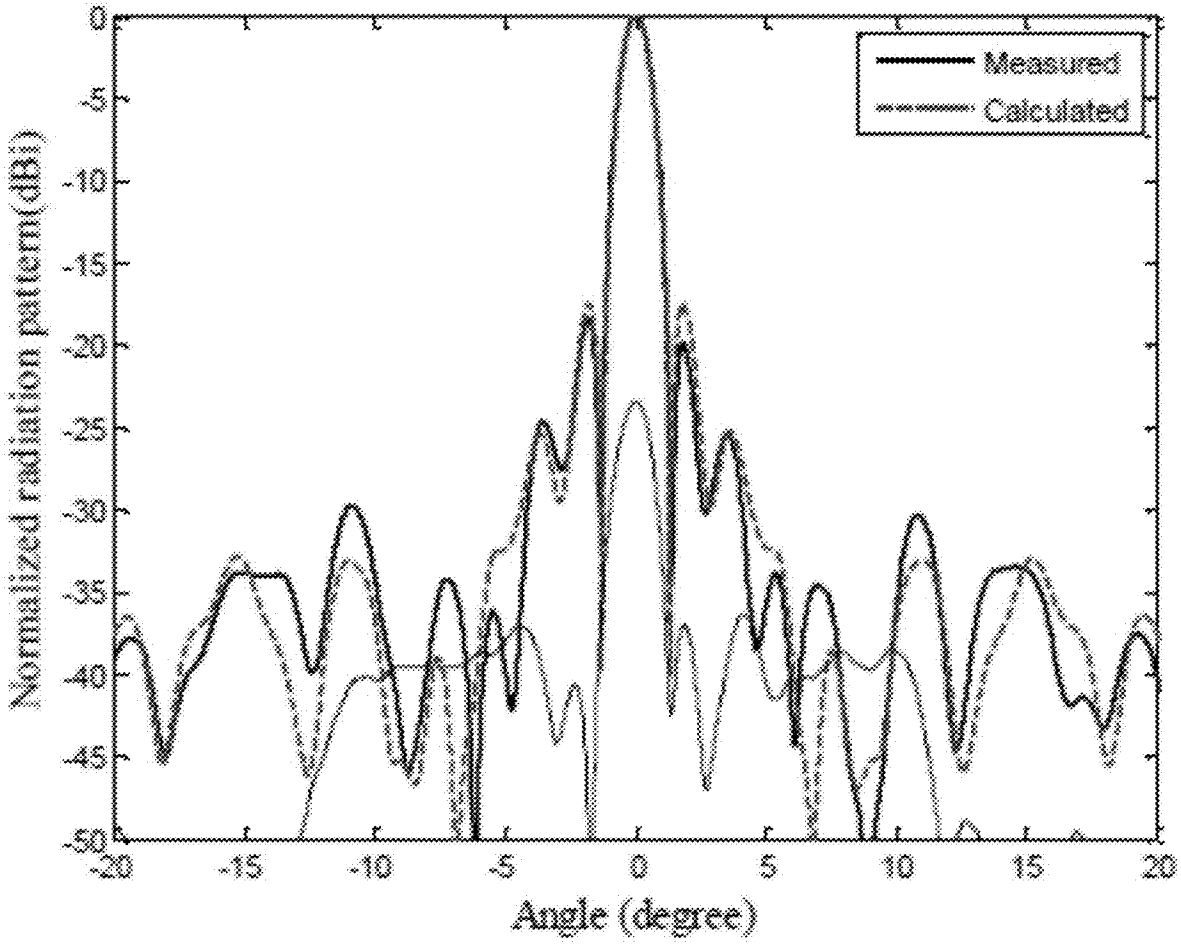
Figure 19:
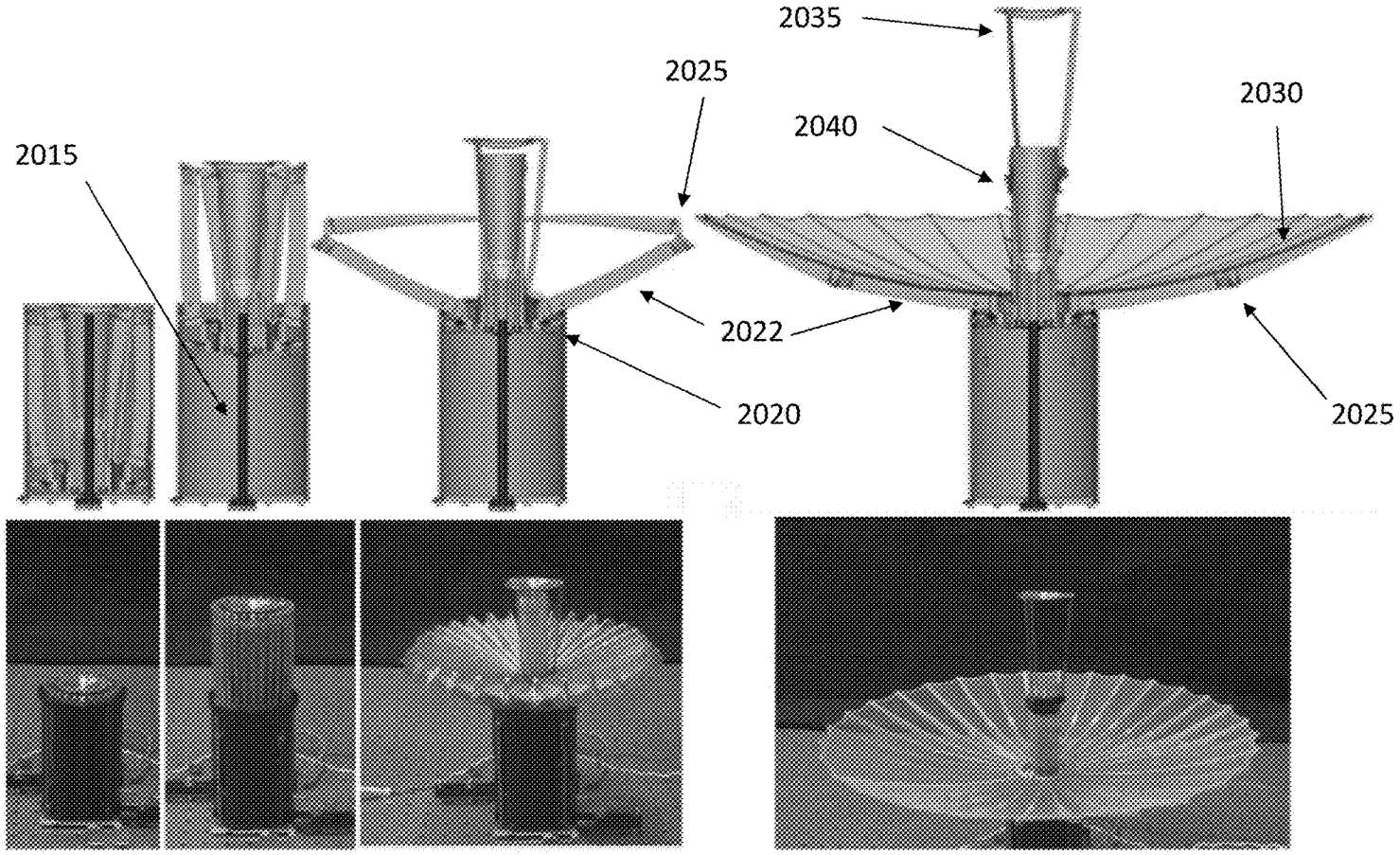
FIG. 19 illustrates an exemplary deployment of an antenna.

The radiation pattern was measured in elevation and azimuth planes at 35.75 GHz. The directivity, gain, loss, and peak SLL are shown in Table II for the solid and mesh antenna prototype. In Table II, the loss is calculated as the difference between the directivity and the gain. The calculated and measured radiation patterns in E- and H-plane are shown in FIGS. 16-17 for the solid non-deploying reflector and they are all in good agreement. The beamwidth equals to 1.17° and 1.14° in E- and H-plane, respectively. The results for the deployable mesh reflector antenna are shown in FIGS. 18-19. FIGS. 16 and 18 refers to $\varphi=0°$, while FIGS. 17 and 19 to $\varphi=90°$. The measured and calculated results are in good agreement with predictions. The mesh does not have any significant impact on the cross-polarization level as it remains roughly identical. After a successful deployment, the mesh was attached and measured to find an initial surface accuracy. The ribs were found to match the desired parabolic shape to within an error of 0.22 mm RMS resulting in 0.47 dB loss according to Ruze's equation, see Ref. [26]. Hence, the numerical analysis has predicted a loss of 0.7 dB for the surface RMS and the mesh opening. The loss resulting from the surface accuracy and mesh opening was assessed by comparing the solid reflector loss and the mesh reflector gain and equals to 0.76 dB.

The predicted and measured gain obtained for the mesh antenna equal 42.59 dBi and 42.48 dBi, respectively. The agreement is excellent and is within the measurement accuracy of the near-field range. The mesh loss $\delta_{mesh}$ can be retrieved by comparing the gain results of the solid reflector $G_{solid}$ and the gain of mesh reflector $G_{mesh}$ as the surface accuracy loss $\delta_{acc}$ was measured ($\delta_{mesh}=G_{solid}-G_{mesh}-\delta_{acc}=43.24-42.48-0.47=0.29$ dB). This is in very good agreement with the calculated mesh loss using GRASP.

TABLE II

| | Directivity (dBi) | | Gain (dBi) | | Loss (dB) | | Peak SLL (dB) | |
|---|---|---|---|---|---|---|---|---|
| | Calc. | Meas. | Calc. | Meas. | Calc. | Meas. | Calc. | Meas. |
| Solid | 43.6 | 43.55 | 43.3 | 43.24 | 0.3 | 0.31 | −17.45 | −17.75 |
| Mesh | — | 43.28 | 42.61 | 42.48 | — | 0.8 | −16.8 | −18.33 |

Stowing a 0.5 meter diameter high gain antenna in 1.5 U is challenging and requires many interactions between RF and mechanical design. Mechanical configurations, which are rather easy to implement, do not provide the required RF performance. On the other hand, optimal RF configurations did not stow well into 1.5 U. The main conflicting challenges occurred in selecting focal length and the number of ribs.

The height of the subreflector is directly influenced by the height of the stowed volume and the number of deployment steps required to deploy the subreflector. For instance, if the subreflector is less than 11 cm above the vertex of the parabola, no deployments are required (4 cm of height is taken up by the base and curvature of the subreflector). If the subreflector is less than 22 cm above the vertex, one deployment step is required. If the subreflector is less than 33 cm above the vertex, two deployment steps are required. In order to reduce complexity, it was desirable to have a maximum of one deployment for the subreflector, which thereby limited its height above the vertex to 22 cm. In addition, the stowage-imposed constraint on rib curvature results in a minimum focal length requirement of 25 cm.

Another key limitation is the number of ribs which can be stowed in the volume. The greater the number of ribs, the more accurate a surface will be. For example, the extreme case of only three ribs creates a parabolic three sided pyramid, which is highly inaccurate, whereas an infinite number of ribs will create a perfectly parabolic surface. The key challenge is balancing RF performance, which improves as the number of ribs increase, and mechanical deployment simplicity and practicality, which improves as the number of ribs decreases. Using 30 ribs maximizes RF performance while still maintaining space between each rib so the antenna does not jam on deployment. In addition, using 30 ribs, a surface RMS of 0.2 mm is achievable which leads to a maximum loss of 0.39 dB. To further improve performance, the best method for attaching the ribs to the mesh was determined to be stitching, as the small stitches do not cause any surface disruptions on the mesh. Roughly 2,000 stitches in the single antenna ensure the mesh will match the curvature of the ribs nearly perfectly. In some embodiments, a different number of ribs or a different method of attaching the ribs may be used.

Another key challenge is to maintain good surface accuracy while adequately tensioning the mesh. 40 OPI mesh is much denser and requires greater force to tension on deployment than the lighter mesh often used on S-band antennas. In some embodiments, each rib requires 12.1 N-cm of torque at its base to fully stretch the mesh. A standard approach to deploy such an antenna is to use strain energy stored in a spring. To provide adequate torque in each rib, a spring deploying the antenna requires 290 N of pre-load after the antenna is fully deployed. Of course, when stowed, the spring produces even greater force, resulting in the antenna being deployed with 860 N of force. This creates an undesirable impact when the antenna is deployed. The innovative deployment mechanism described below was developed to solve this problem.

The antenna deployment sequence is a one-time occurrence that moves the antenna from a stowed state to a deployed state. The sequence is illustrated in FIG. 19. In a first step (2005), the antenna is being held in place by a thermal knife launch lock, as can be understood by the person of ordinary skill in the art. The launch lock is released by a heated source cutting through the polymer wire.

In a subsequent step (2010), gas is pumped into the canister (2015), slowly lifting the base of the antenna up and out of the CubeS at. This was a key innovation which enabled antenna deployment. The gas can be produced by a powder which sublimates when heated, or by a cool gas generator, for example the generators developed by Cool Gas Generator Technologies as described in Ref. [31]. As the base of the antenna nears the top of the canister, the root ribs (2022) interlock (2020) with a latch on the base of the antenna, pulling the ribs outward. Different methods may be use for the interlock. For example, mechanical hooks may be used in such as a shape as to enable the interlocking of the root ribs with the latch. Since the pressurized gas acts over a surface area, only 42.0 kPa of pressure is required to apply the a 290 N force to fully deploy the ribs and tension the mesh. As the root ribs move outward, a constant-force spring located in the mid rib hinge deploys the tip ribs (2030). Once the ribs (2030, 2022) fully deploy, the subreflector (2035) is released and a compression spring telescopes it along the horn (2040). By correctly defining machining tolerances, the sub-reflector will deploy to within 0.2 mm on the z-axis and 0.1 mm on the x and y-axis of its ideal position. As the subreflector is kept under pre-load by a spring, it reliably deploys to the same position defined by the machining tolerances. When the hub is elevated into its fully deployed location, latches lock the hub in place to ensure the antenna stays in the deployed position, even if the canister depressurizes. A detailed descriptions of these mechanical developments have been discussed also in Ref. [32].

As described above in the present disclosure, while the capabilities of CubeSats have greatly increased in the past years, one of the key problems hindering interplanetary CubeSats are data communication rates. To compensate, a Ka-band high gain antenna would provide a 10,000 times increase in data communication rates over an X-band patch antenna and a 100 times increase over state-of-the-art S-band parabolic antennas. As discussed above in the present disclosure, mesh parabolic deployable antennas have several advantages over competing technologies. There are many concepts for mesh parabolic deployable antennas at much larger scales than CubeSats. In the 1970's Lockheed Martin developed the Wrap-Rib reflector, which uses a mechanism to wrap the ribs and mesh like a tape measure. However, the design does not fit well in the CubeSat form factor, as the mechanism that deploys and stows the ribs is quite large. There are also a number of knit mesh reflectors, the most popular of which are Harris's Unfurlable Antenna and Northrop Grumman's AstroMesh. However, these two designs consist of many small, detailed components, which are challenging to scale down without the antenna becoming prohibitively expensive.

Two knit mesh antennas have been developed for CubeSats, but both were designed for S-band operation. They were a spiral stowed rib design and the ANEAS parabolic deployable antenna (APDA) folding rib design that was used on USC/ISI's ANEAS spacecraft. The spiral stowed rib design, while very compact, would be challenging to extend to Ka-band as the ribs could not apply adequate force required to stretch Ka-band mesh to achieve the required surface accuracy. The APDA architecture would work well for Ka-band, as it uses straight folding ribs, which can apply more force and allow for greater surface accuracy. In addition, the APDA is the only CubeSat parabolic deployable antenna to have flown. Therefore, it was decided to use the APDA as a starting point for the Ka-band parabolic deployable antenna (KaPDA) design.

A number of designs were explored including Cassegrainian, Gregorian, and several hat-style feeds. While the Gregorian design performed the best with 44 dB of gain, the sub-reflector had to be mounted too high to be practically stowed within 1.5 U. The hat-style feeds both performed around 43 dB. Finally, the Cassegrainian configuration achieved 43.6 dB of gain and the dimensions for the sub-reflector were such that it could be stowed within 1.5 U. Therefore, the KaPDA design utilizes a Cassegrainian configuration.

The number of ribs supporting the mesh structure is a key factor for achieve surface accuracy, which is critical at Ka-Band. More ribs result in a more ideal dish, and thus greater RF gain. However, as the number of ribs increase, the clearance between each rib when stowed decreases. Packing ribs too tightly can result in snagging during deployment. The best compromise between rib clearance and RF loss due to a non-ideal shape was found to be 30 ribs. Beyond 30 ribs, the RF gains were not significant enough to warrant packing the ribs closer together, as it left less than three-quarters of a millimeter of clearance between each rib. However, in other embodiments a different number of ribs may be used.

Figure 20:
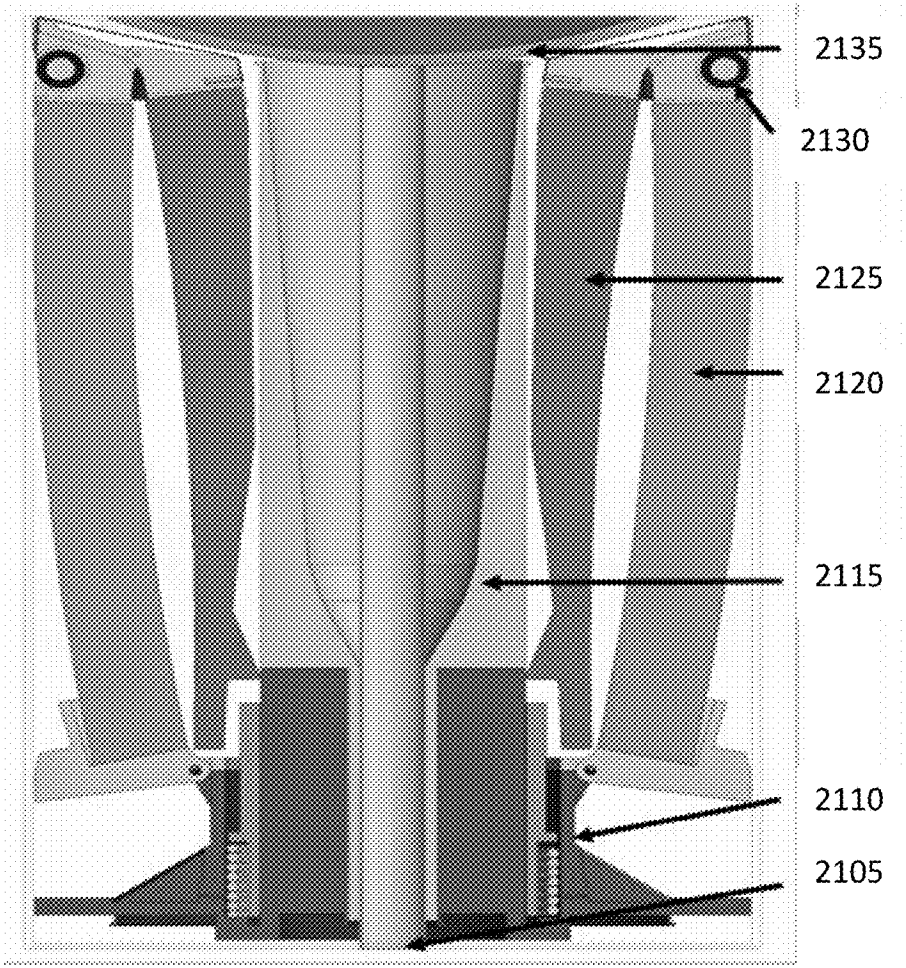
FIG. 20 illustrates several components of a packed antenna.

As illustrated in FIG. 20, an antenna may comprise a waveguide outlet (2105) for communication, a hub (2110), a horn (2115), root ribs (2120), tip ribs (2125), constant-force springs (2130) located at hinges between the root ribs and the tip ribs, and a subreflector (2135).

In some embodiments, as illustrated in FIG. 20, each rib is divided into two components, the root rib and tip rib, which are connected by a hinge. The mesh forces and resulting moments determine the geometry of the rib. As the root ribs will experience the greatest bending moment, they are deeper than the tip ribs. The tip ribs have a tapered design to conserve space and eliminate material where it was not required for rigidity. The taper was designed to create an even stress profile throughout each rib. To improve both stowing efficiency and surface accuracy, the ribs are much deeper (by over 10 times) but slightly thinner than those used on APDA. The deep rib design also can be advantageous for precisely controlling the rib's deployed position, as a rib hinge with a mechanical stop over twelve millimeters away from the hinge pin is significantly more effective than one located near the hinge pin.

The deployment mechanism must first push the hub out of out of the CubeSat and then unfold the ribs, and must do so within the tight constraint of 1.5 U. The APDA was deployed entirely using springs, with all the components unfolding quickly. However, Ka-band uses a 40 opening per inch (OPI) mesh, which is stiffer and requires greater deployment forces (APDA only used a 10 OPI mesh). Therefore, the method employed previously with APDA would not be suitable for the antennas described in the present disclosure. A preload of approximately 250 N was required at the end of the spring's displacement, which means any stowed spring would likely be compressed to well over 500 N, resulting in a violent deployment. Therefore, other concepts for deploying the hub and ribs had to be explored.

To deploy the hub, a number of concepts were explored including motors driving threaded rods, a scissors lift, low force springs (if hub deployment was decoupled from rib deployment), cables and pulleys driven by motors, and an inflating bladder. Many concepts were eliminated because of complexity (e.g. cables and pulleys driven by motors), as these methods are challenging to implement within the highly constrained space (e.g. scissors lift), or they didn't work (e.g. low force springs). The most attractive deployment mechanism was the inflating bladder, as it stows well in a small space and allows for a controlled deployment. The inflation of the bladder would push the hub upwards into the deployed position. To inflate the bladder, a heater would activate a sublimating compound or a gas entrapped in a solid, causing the release of gas. In the vacuum of space, two micro cool gas generators (CGGs), could provide enough gas to inflate the bladder to the required pressure. After deployment, a latch would be used to lock the hub in place to ensure if the bladder deflated the antenna would remain fully deployed. This embodiment has been described above in the present disclosure. However, in certain cases, it is possible for the inflating bladder to not stow well and have attachment problems. A simpler solution can be used in other embodiments, to convert the hub of the antenna into a piston, which compressed gas could push up into a deployed position. This also provides greater surface than a bladder would, and reduces friction loads, which means less pressure is required to deploy the antenna.

Figure 21:
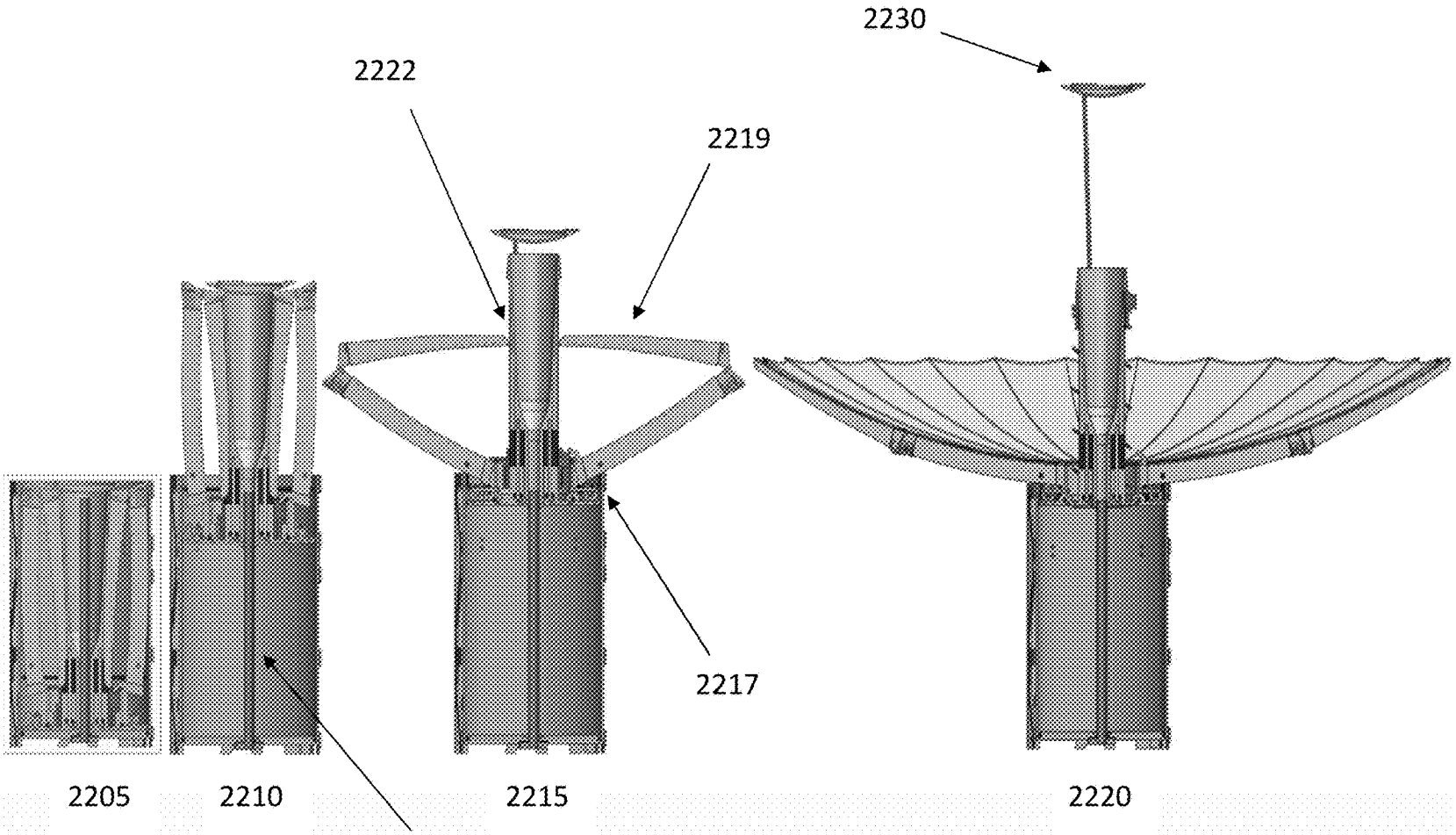
FIG. 21 illustrates an exemplary deployment of an antenna.

To stow in 1.5 U the antenna ribs fold in half using precision hinges. To deploy, the hub is driven upwards by a compressed gas pushing on a piston (2212), as illustrated in FIG. 21 (2205,2210). As the hub starts to get close to the top, the root rib base hinges catch on a snap ring (2217) in the top of the cube sat canister, and the ribs begin to deploy (2210,2215). The tip ribs (2219) reach a point where they become free of the horn (2222) interference, and the constant force springs deploy them (2215). The hub continues to travel upwards until the root ribs have fully deployed (2220). As the ribs fold outwards, the sub-reflector (2230) is released by the root rib hinges and telescopes along the horn, pushed upward and held in place by a spring (2215,2220). After the hub is fully deployed, it is locked into place by spring loaded latches. The person of ordinary skill in the art will understand that springs and latches are components known in the art and their operation need not be described in details, since several types of latches or springs could be used in a similar fashion.

Figure 22:
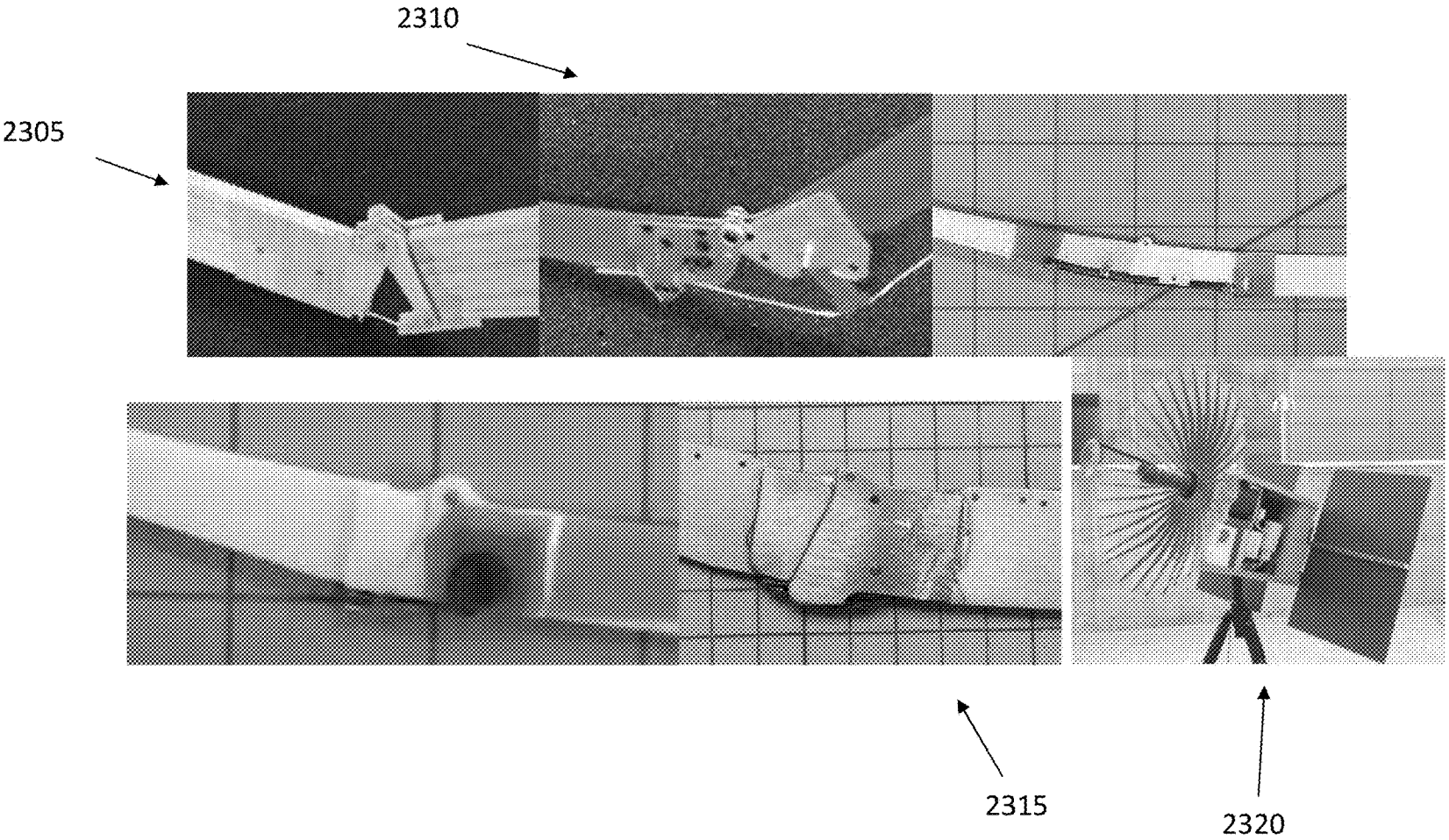
FIG. 22 illustrates exemplary hinges to deploy ribs.

The antenna construction process began with early prototyping of the ribs, the hub and inflating bladder. The prototypes were initially extremely rough but became more refined with each iteration. Each iteration of a concept, resulted in changes that improved the design. For example, the rib mid-hinge went through a series of changes through prototyping. As illustrated in FIG. 22, the first balsawood prototype (2305) was built much larger than scale, but informed importance decisions about cable routing. The second hinge (2310), built from 3D printed Makerbot parts and sheet metal cut with a tin snips tested a cable routing mechanism. However, it was also discovered the new hinge design lacked torsional stiffness when compared to the balsawood prototype, which had multiple laminations. Therefore a tang and clevis were added to the next design. Also, as it was determined cables would be hard to manage and not easily provide the required displacement, the design was simplified by replacing the cables with a single spring. Multiple versions of the spring powered mid-hinge were 3D printed and assembled with different springs. The design using a constant force spring was determined to work well, and was built into a final 3D printed concept. The 3D printed concept revealed where radii could be added to ease transition in the constant force spring. These changes were implemented on the final machined part (2315) in FIG. 22.

Additionally, a 3D printed model of the entire antenna was built (2320), and a mesh was attached to the surface using Loctite™ 496 (for demonstration purposes only). To do this, the mesh was tensioned over a square frame, and then weights were applied to the center of the mesh to pull it down to be bonded to the surface of the ribs. After the mesh was attached to the rib surface, the edges were cut. Due to the internal stresses caused when knitting the mesh, when the mesh was cut it curled and slightly unraveled along the edges. On the flight antenna, this would cause undesirable surface distortions. Therefore, to maintain a clean edge, it was recognized that that the mesh would require a flexible edging reinforced with a small cable.

After building a number of preliminary prototypes, two flight-like prototypes using aluminum machined parts were constructed. The first prototype was a non-deploying RF prototype, which would be used to verify the RF models of antenna performance, and the second was a mechanical deploying prototype to test deployed surface accuracy and deployment characteristics. The mesh was later be added to the mechanical prototype, to create a combined RF/Mechanical prototype which could be RF tested. The RF prototype was relatively simple to build, as it just required accurate machining and the assembly of various piece parts. The most challenging component was the secondary reflector, which consisted of an aluminum base and top, connected with three stainless steel struts bonded in place. A precision bonding fixture was required to construct this component.

The mechanical deploying prototype was more complex as it required the assembly of over 600 parts with sub-millimeter precision. The most challenging step is the assembling of the ribs and mesh.

Figure 23:
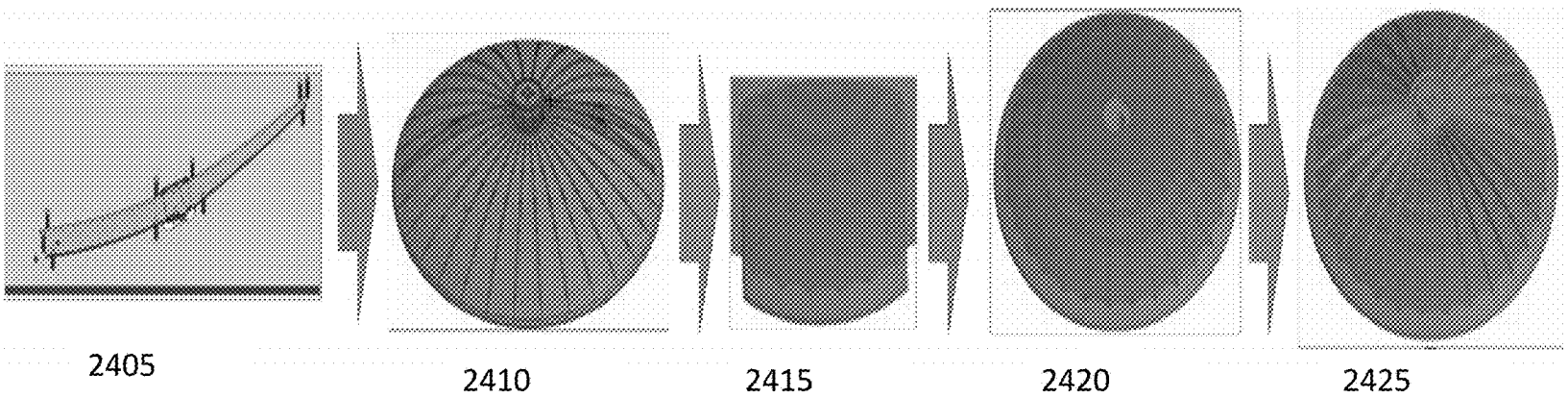
FIG. 23 illustrates an exemplary mesh attachment process.

The construction of the ribs begins by machining the rib's parabolic profile with high precision. In a next step the ribs and mid-hinges are assembled on a precision bonding fixture as illustrated in FIG. 23 (2405). The ribs are wedged against pins which precisely define the parabolic shape. Next, to bond the ribs to the root hinges, the ribs are assembled on the parabolic mold made for the mesh (2410). An upward force is applied to each root hinge, to ensure they are fully seated in the hub. After bonding, the ribs are moved from the mold and the process of meshing the antenna begins.

While it would have been ideal to make the antenna out of one piece of mesh, because of the stiffness of the 40 OPI mesh it was required to use three segments. This created a challenge of stretching multiple segments of mesh and then joining them in their fully stretched stage. To achieve this, each segment of mesh was first laid on a square mold and then weighted down (2415). Next, these segments of mesh were stitched together, then laid on the parabolic mold, and weights were applied to the perimeter (2420). Subsequently, the hub with all of the ribs was set on top of the mesh, and the ribs were stitched to the mesh with over 1,200 small holes on the edge of the ribs (2425).

As the RF prototype had fewer parts, it was completed and tested first. Simulation of the solid reflector predicted a total gain of 43.3 dBi (which is higher than that of the mesh reflector, as the solid reflector has a better surface accuracy and no seepage losses). The solid reflector's RF performance aligned with the simulations, producing a total gain of 43.2 dBi. This demonstrated that the RF models were correct and the secondary reflector was properly designed.

After the mechanical prototype was completed, a mechanical deployment test occurred to ensure the all the mechanisms were properly designed. Due to tolerance issues, it was discovered the ribs had to be modified slightly to enable the antenna to deploy. After a successful mechanical deployment, the next step was to attach the mesh, as illustrated in FIG. 23 steps (2410) to (2425). The fully meshed reflector was then RF tested immediately after construction and before stowing to characterize the pre-deployment gain of the antenna, which demonstrated that the meshed reflector aligned with the analytical model, producing 42.5 dBi of gain, and exceeded the goal by 0.5 dBi. The surface accuracy of the antenna was also measured, using a Faro arm to characterize the position of each rib. The accuracy for the ribs was found to be 0.22 mm RMS. The next step in the test campaign was to stow and deploy the antenna, and obtain post deployment RF measurements.

Stowing the antenna was a 3 hour process, which required very careful manipulation of the mesh to ensure it did not crease in the stowing process. Specialized wooden tools were required to manipulate the mesh while folding the ribs, as the mesh is very sensitive. After the stowing process, an air hose was connected to the antenna canister, and pressurized air was slowly released to drive the antenna upwards, deploying it slowly. After deployment was complete, the antenna was taken to the RF range for a follow up test. It was found that the gain had dropped 0.5 dBi, to 42.0 dBi after deployment. Because of the drop in gain the surface accuracy was measured post deployment, and was found to have increased to 0.25 mm RMS. However, this only accounted for a portion of the gain drop. Careful examination of the antenna found some very minor creases in the mesh (less than 0.5 mm in height), occurring in a circle at the hinge joints. It is believed these deformations accounted for the rest of the gain loss. However, the antenna still met the goal of achieving 42 dBi of gain.

The antennas described in the present disclosure can therefore be used to increase data rate and also to operate as radio antennas in various applications.

Figure 24:
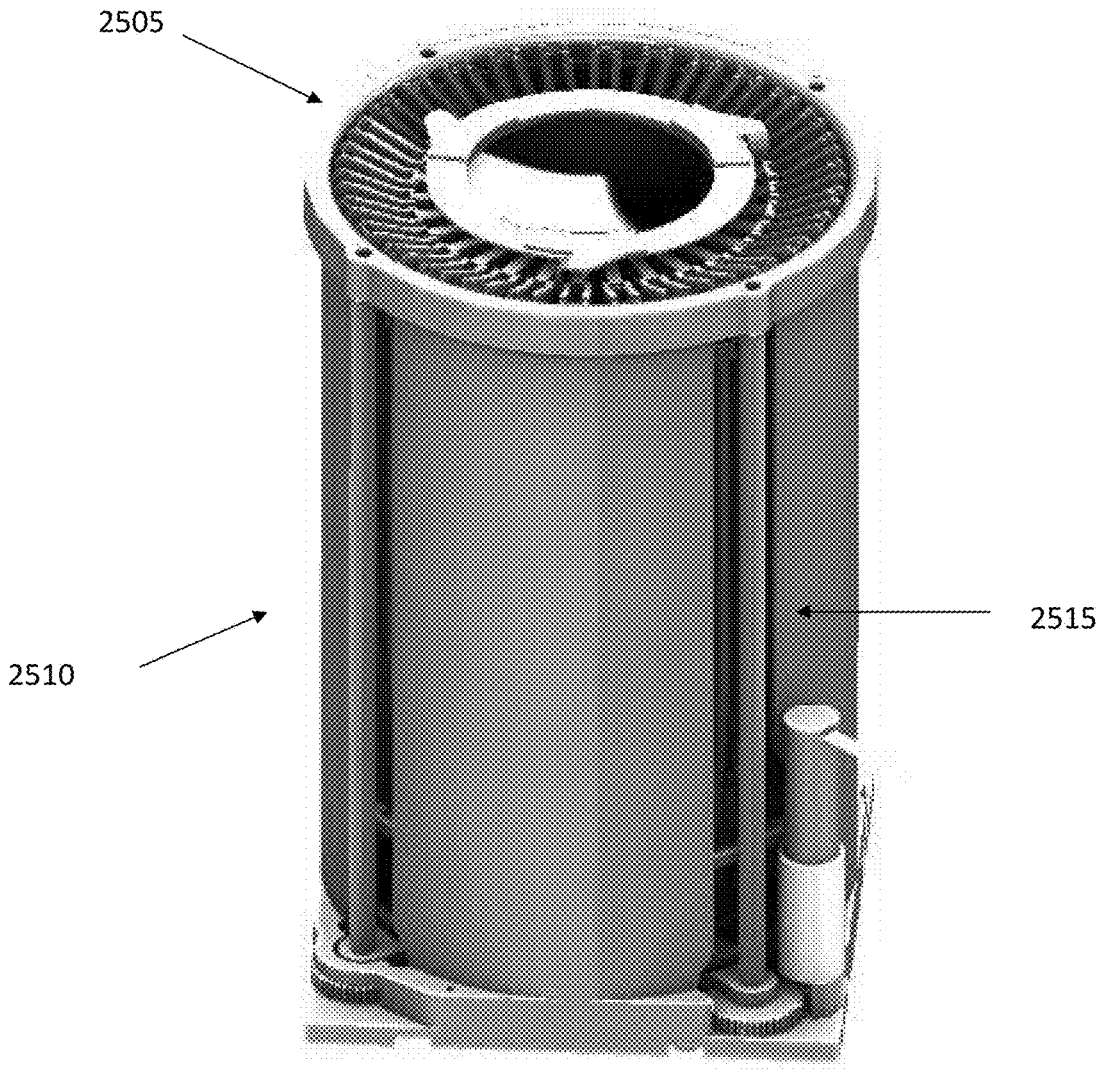
FIG. 24 illustrates an embodiment with screws.
Figure 25:
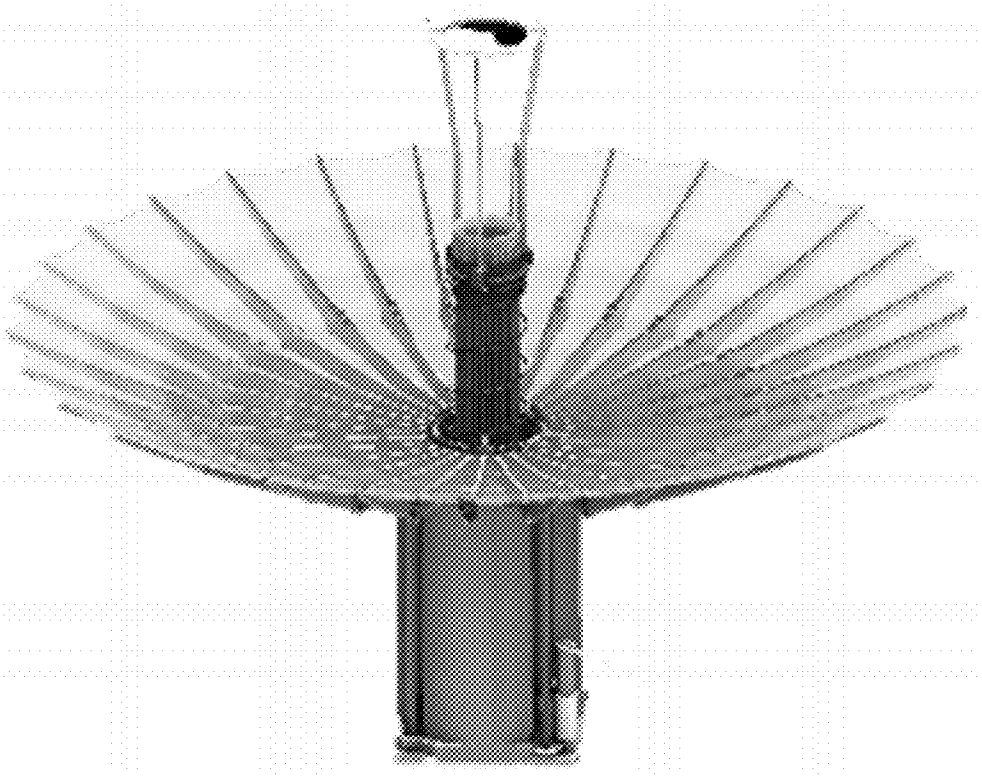
FIG. 25 illustrates an embodiment of the antenna with the four screw deployment.

FIG. 24 illustrates an alternative embodiment where instead of a gas generator, a screw design is employed. The folded antenna (2505) is visible in FIG. 24 within a canister (2510). Screws (2515) are installed around the cylindrical container. For example in the embodiment of FIG. 24, four screws were used. The screws keep the hub level and allow a slow deployment. By replacing the gas generator, the need for latches can be eliminated. A launch lock is also unnecessary in this embodiment. This embodiment provides a deployment status, reduces costs of deployment tests and eliminates the canister of pressurized gas. FIG. 25 illustrates an embodiment of the antenna with the four screw deployment. The screws are motorized in order to provide the force necessary for deployment. Measurements show that the motorized deployment provides improvement in performance, as can be seen in Table III.

As described above, the present disclosure describes a deployable antenna that can be stored within 1.5 U and comprises the following advantages: 1. Telescoping waveguide; 2. Constant force spring hinge deployment, where the hinge and spring are integrated in one unit; 3. Release and vibration suppression features (specifically related to timing the sub-reflector and holding the ribs against vibration); 4. Sun synchronizing gear to enable one motor to drive the deployment while all four threaded rods stay in sync; 5. Design which also uses the threaded rods to provide preload as a launch lock; 6. Root rib spring ring actuation mechanism, and unique features in the additively manufactured spring ring which allow free movement of the extension springs. It also utilizes a lever arm and hard stop in the design which allows maximizing deployment force while minimizing deployment impact; 7. Telescoping Cassegrain secondary reflector to minimize stowed height. The Ka-band normally extends between 26.5 and 40 GHz.

TABLE III

| Quantity | Units | Goal | Simulated | Pre-Deploy | 1st Deploy | 2nd Deploy |
|---|---|---|---|---|---|---|
| Stowed Size | U (10 × 10 × 10 cm^3) | 1.5 | 1.54 | 1.54 | 1.54 | 1.54 |
| Deployed Diam. | meter | 0.5 | 0.51 | 0.51 | 0.51 | 0.51 |
| Gain | dB | 42 | 42.6 | 42.5 | 42.0 | 42.7 |
| Beam width | degrees | 1.2 | 1.2 | 1.2 | 1.2 | 1.2 |
| Surface Accuracy | mm | 0.40 | — | 0.22 | 0.25 | — |
| Mass | kg | 3.0 | 1.9 | 1.2 | 1.2 | 1.2 |
| Thermal | ° C. | −17 to 35 | −26 to 62 | — | — | — |

In other embodiments, the antennas can operate at different bands. For example, the antenna can operate in any band between 2 GHz and 50 GHz. In some embodiments, the antenna is dedicated to RADAR applications. However, in other embodiments the antennas operate for telecommunications. In some embodiments, a rectangular to circular transition is employed. However, in other embodiments, for example for telecom applications, a polarizer is used instead of a rectangular to circular transition. In some embodiments, a circular telescoping waveguide is used, to be able to generate any polarization: linear H or V, or circular (RHCP or LHCP).

In some embodiments with motorized deployment, the antennas may comprises sun synchronizing gear to enable one motor to drive the deployment while all four threaded rods stay in sync. In other embodiments, the threaded rods can provide a preload as a launch lock.

In some embodiments, the deployable structure described in the present disclosure for deployable antennas may be used as a solar collector with some modifications. For example, the mesh may be configured to reflect solar radiation and collect it for energy production. The structure may be folded and stowed similarly to the deployable antenna, and deploy in a similar manner.

In some embodiments, The deployable antenna further comprises arms on the root ribs and top ribs, first slots on the horn and second slots on the cylindrical container, the arms, first slots and second slots configured to operate release of and vibration suppression for the deployable antenna. The deployable antenna can also comprise arms, first slots and second slots configured to time deployment of the sub-reflector and hold the root and top ribs against vibration.

The present disclosure also describes a telescoping waveguide comprising a waveguide configured to extend from a housing and configured to operate as part of an antenna or RF assembly. The present disclosure also describes a constant force spring hinge deployment, comprising a hinge and a spring integrated in one unit as part of a deployable structure. In some embodiments, the constant force spring hinge deployment comprises a constant force spring mounted on a spool.

A number of embodiments of the disclosure have been described. Nevertheless, it will be understood that various modifications may be made without departing from the spirit and scope of the present disclosure. Accordingly, other embodiments are within the scope of the following claims.

The examples set forth above are provided to those of ordinary skill in the art as a complete disclosure and description of how to make and use the embodiments of the disclosure, and are not intended to limit the scope of what the inventor/inventors regard as their disclosure.

Modifications of the above-described modes for carrying out the methods and systems herein disclosed that are obvious to persons of skill in the art are intended to be within the scope of the following claims. All patents and publications mentioned in the specification are indicative of the levels of skill of those skilled in the art to which the disclosure pertains. All references cited in this disclosure are incorporated by reference to the same extent as if each reference had been incorporated by reference in its entirety individually.

It is to be understood that the disclosure is not limited to particular methods or systems, which can, of course, vary. It is also to be understood that the terminology used herein is for the purpose of describing particular embodiments only, and is not intended to be limiting. As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

The references in the present application, shown in the reference list below, are incorporated herein by reference in their entirety.

REFERENCES

[1] E. Peral, S. Tanelli, Z. S. Haddad, G. L. Stephens, and E. Im, "RaInCube: a proposed constellation of precipitation profiling Radars In Cubesat," *AGU Fall Meeting*, San Francisco, December 2014.

[2] M. K. Yau and R. R. Rogers (1989). "Short Course in Cloud Physics, Third Edition," Butterworth-Heinemann, ISBN: 0750632151.

[3] A. Babuscia, B. Corbin, M. Knapp, R. Jensen-Clem, M. Van de Loo, and S. Seager, "Inflatable antenna for cubesats: Motivation for development and antenna design," *Acta Astronautica*, Vol. 91, October-November 2013, Pages 322-332, ISSN 0094-5765.

[4] R. Hodges, D. Hoppe, M. Radway, and N. Chahat, "Novel deployable reflectarray antennas for CubeSat communications", *IEEE MTT-S International Microwave Symposium* (*IMS*), Phoenix, Az, May 2015.

[5] M. R. Aherne, J. T. Barrett, L. Hoag, E. Teegarden, R. Ramadas, "Aeneas—Colony I meets three-axis pointing," 5th Annual AIAA/USU Conference on Small Satellites, Aug. 7-12, 2011.

[6] N. Chahat, J. Sauder, R. Hodges, M. Thomson, and Y. Rahmat-Samii, "CubeSat deployable Ka-band reflector antenna for deep space missions," APS/URSI 2015, Vancouver, Canada, July 2015.

[7] C. S. MacGillivray, "Miniature deployable high gain antenna for CubeSats." 2011 CubeSat Developers Workshop. California Polytechnic State University San Luis Obispo, Calif., Apr. 22, 2011.

[8] R. Freeland, S. Bard, G. Veal, G. Bilyeu, C. Cassapakis, T. Campbell, and M. C. Bailey, "Inflatable antenna technology with preliminary shuttle experiment results and potential applications", 18th Annual Meeting and Symposium, Antenna Measurement Techniques Association, Seattle, Wa, Sep. 30-Oct. 3, 1996.

[9] J. Huang and J. A. Encinar, "Reflectarray antennas," *Wiley-IEEE Press*, October 2007, ISBN: 978-0-470-08491-5.

[10] R. Hodges, M. Zawadzki, "Ka-band reflectarray for interferometric SAR altimeter," *Joint IEEE/URSI Int. Symp. on Antennas and Propagat*, Chicago, Ill., July 8-14, 2012.

[11] C. Han, J. Huang, and K. Chang, "A high efficiency offset-fed X/Ka dual-band reflectarray using thin membranes" *IEEE Trans. Antennas and Propag.*, vol. 53, no. 9, pp. 2792-2798, September 2005.

[12] C. Granet, "Designing classical offset Cassegrain or Gregorian dual-reflector antennas from combinations of prescribed geometric parameters," *IEEE Antennas Propag. Mag.*, vol. 44, no. 3, pp. 114-123, June 2002.

[13] S. F. Bassily and M. W. Thomson, "Chapter 8: Deployable reflectors" in S. Rao, L. Shafai, and S. K. Sharma, "Handbook of reflector antennas and feed systems volume III: applications of reflectors," *Artech House*, Norwood, Mass., USA, 2013, ISBN-10: 160807515X.

[14] M. Johnson, "The Galileo high gain antenna deployment anomaly," *JPL Technical Report*, May. 1994.

[15] P. Focardi, P. Brown, and Y. Rahmat-Samii, "A 6-m mesh reflector antenna for SMAP: modeling the RF performance of a challenging Earth-orbiting instrument," *IEEE Int. Symp. Antennas Propag.* (*APSURSI*), pp. 2987-2990, 3-8 Jul. 2011.

[16] E. Hanayama, S. Kuroda, T. Takano, H. Kobayashi, N. Kawaguchi, "Characteristics of the large deployable antenna on HALCA Satellite in orbit," *IEEE Trans. Antennas Propag.*, vol. 52, no. 7, pp. 1777-1782, July 2004.

[17] A. G. Roederer and Y. Rahmat-Samii, "Unfurlable satellite antennas: A review," *Annales Des Télécommunications*, vol. 44, no. 9-10, pp 475-488, September/October 1989.

[18] G. Tibert, Deployable Tensegrity Structures for Space Applications. TRI-MEK Technical Report 2002:04, ISSN 0348-467X, ISRN KTH/MEK/TR-02/04-SE

[19] W. D. Williams, M. Collins, R. Hodges, R. S. Orr, O. Sands, L. Schuchman, H. Vyas, "High-Capacity Communications from Martian Distances—Chapter 5," *NASA Tech Report*, NASA/TM-2007-214415, NASA Glenn Research Center, Cleveland, Ohio, March 2007.

[20] W. Reynolds, T. Murphey, and J. Banik, "Highly Compact Wrapped-Gore Deployable Reflector," in 52nd AIAA/ASME/ASCE/AHS/ASC Structures, Structural Dynamics and Materials Conference, 2011.

[21] V. Shirvante, S. Johnson, K. Cason, K. Patankar, and N. Fitz-Coy, "Configuration of 3 U CubeSat Structures for Gain Improvement of S-band Antennas," AIAAUSU Conf. Small Satell., August 2012.

[22] A. Babuscia, B. Corbin, M. Knapp, R. Jensen-Clem, M. Van de Loo, and S. Seager, "Inflatable antenna for cubesats: Motivation for development and antenna design," Acta Astronaut., vol. 91, pp. 322-332, October 2013.

[23] M. Aherne, T. Barrett, L. Hoag, E. Teegarden, and R. Ramadas, "Aeneas—Colony I Meets Three-Axis Pointing," AIAAUSU Conf. Small Satell., August 2011.

[24] C. "Scott" MacGillivray, "Miniature High Gain Antenna for CubeSats," presented at the 2011 CubeS at Developers Workshop, California Polytechnic State University San Luis Obispo, Calif., 22 Apr. 2011.

[25] N. Chahat and R. Hodges, "Enabling deep space cubesat missions," *Mars CubeSat/NanoSat workshop*, Pasadena, Nov. 20-21, 2014.

[26] J. Ruze, "Antenna tolerance theory—A review," *Proceedings of the IEEE*, vol. 54, no. 4, pp. 633-640, April 1966.

[27] Y. Rahmat-Samii, "An efficient computational method for characterizing the effects of random surface errors on the average power pattern of reflectors," *IEEE Trans. Antennas Propag.*, vol. 31, pp. 92-98, January 1983.

[28] Y. Rahmat-Samii, "Reflector Antennas", Chapter 15 in Y. T. Lo and S. W. Lee, "Antenna handbook: Theory, applications, and design,"*Springer,* 1998, ISBN 978-1-4615-6459-1.

[29] P. Ingerson and W. C. Wong, "The analysis of deployable umbrella parabolic reflectors," *IEEE Trans. Antennas Propag.* vol. 20, no. 4, pp. 409-414, July 1972.

[30] R. Corkish, "The use of conical tips to improve the impedance matching of cassegrain subreflectors," *Microw. Optical Techn. Letters*, vol. 3, no. 9, pp. 310-313, September 1990.

[31] "Cool Gas Generator Technologies." [Online]. Available: http://cgg-technologies.com/. [Accessed: 17 Oct. 2014].

[32] J. Sauder, N. Chahat, M. Thomson, R. Hodges, E. Peral, and Y. Rahmat-Samii, "Ultra-compact Ka-band parabolic deployable antenna for RADAR and interplanetary Cube- Sats," 29*th Annual AIAA/USU Conference on Small Satellites*, Logan, Utah, USA, August 2015.

What is claimed is:

1. A deployable antenna comprising:

a container;

a deployment mechanism attached to the container;

a hub within the container, configured to deploy along a longitudinal axis of the container upon activation of the deployment mechanism;

a plurality of root ribs attached to the hub and configured to rotate away from the longitudinal axis upon deployment;

a plurality of tip ribs, each tip rib attached to a corresponding root rib by a rotating hinge, the plurality of tip ribs configured to rotate away from the longitudinal axis upon deployment;

a mesh attached to the plurality of root and tip ribs;

a horn attached to the hub, the horn extending along the longitudinal axis and located centrally to the mesh;

a sub-reflector attached to the horn and configured to extend away from the horn along the longitudinal axis upon deployment; and a waveguide attached to the hub, the waveguide being configured to fit within the horn before deployment and to remain in its pre-deployment location while the hub and the horn are extended away along the longitudinal axis upon deployment, wherein:

the mesh, horn, root ribs, tip ribs and sub-reflector are configured to operate between 2 and 50 GHz, and the deployable antenna is a Cassegrain antenna optimized to operate at 35.75 GHz with a bandwidth of 20 MHz.

2. The deployable antenna of claim 1, wherein the container is a cylindrical container and has a volume smaller than $10\times10\times16.2\ cm^3$.

3. A deployable antenna comprising:

a container;

a deployment mechanism attached to the container;

a hub within the container, configured to deploy along a longitudinal axis of the container upon activation of the deployment mechanism;

a plurality of root ribs attached to the hub and configured to rotate away from the longitudinal axis upon deployment;

a plurality of tip ribs, each tip rib attached to a corresponding root rib by a rotating hinge, the plurality of tip ribs configured to rotate away from the longitudinal axis upon deployment;

a mesh attached to the plurality of root and tip ribs;

a horn attached to the hub, the horn extending along the longitudinal axis and located centrally to the mesh; and a sub-reflector attached to the horn and configured to extend away from the horn along the longitudinal axis upon deployment, wherein the mesh, horn, root ribs, tip ribs and sub-reflector are configured to operate between 2 and 50 GHz, wherein the deployment mechanism comprises a cool gas generator attached to a piston, the piston being attached to the hub and configured to push the hub upon activation of the cool gas generator.

4. A deployable antenna comprising:

a container;

a deployment mechanism attached to the container;

a hub within the container, configured to deploy along a longitudinal axis of the container upon activation of the deployment mechanism;

a plurality of root ribs attached to the hub and configured to rotate away from the longitudinal axis upon deployment;

a plurality of tip ribs, each tip rib attached to a corresponding root rib by a rotating hinge, the plurality of tip ribs configured to rotate away from the longitudinal axis upon deployment;

a mesh attached to the plurality of root and tip ribs;

a horn attached to the hub, the horn extending along the longitudinal axis and located centrally to the mesh; and a sub-reflector attached to the horn and configured to extend away from the horn along the longitudinal axis upon deployment, wherein the mesh, horn, root ribs, tip ribs and sub-reflector are configured to operate between 2 and 50 GHz, wherein the deployment mechanism comprises a plurality of motorized screws.

5. The deployable antenna of claim 1, wherein a diameter of the deployed antenna is 0.5 m.

6. The deployable antenna of claim 3, wherein the plurality of root ribs comprises latches to lock onto an outer edge of the container upon deployment.

7. The deployable antenna of claim 1, wherein the mesh is a 40 openings-per-inch mesh knitted from 0.0008" diameter gold plated Tungsten wire.

8. The deployable antenna of claim 4, further comprising a sun synchronizing gear configured for one motor to drive deployment while the plurality of motorized screws operates synchronously.

9. The deployable antenna of claim 4, wherein the plurality of motorized screws is configured to operate as a launch lock.

10. A method comprising:

providing a deployable antenna, the deployable antenna comprising:

a container;

a deployment mechanism attached to the container;

a hub within the container, configured to deploy along a longitudinal axis of the container upon activation of the deployment mechanism;

a plurality of root ribs attached to the hub and configured to rotate away from the longitudinal axis upon deployment;

a plurality of tip ribs, each tip rib attached to a corresponding root rib by a rotating hinge, the plurality of tip ribs configured to rotate away from the longitudinal axis upon deployment;

a mesh attached to the plurality of root and tip ribs;

a horn attached to the hub, the horn extending along the longitudinal axis and located centrally to the mesh; and a sub-reflector attached to the horn and configured to extend away from the horn along the longitudinal axis upon deployment; and a waveguide attached to the hub, the waveguide being configured to fit within the horn before deployment and to remain in its pre-deployment location while the hub and the horn are extended away along the longitudinal axis upon deployment, wherein:

the mesh, horn, root ribs, tip ribs and sub-reflector are configured to operate between 2 and 50 GHz, the deployable antenna is a Cassegrain antenna optimized to operate at 35. 75 GHz with a bandwidth of 20 MHz;

activating the deployment mechanism, thereby deploying the hub along a longitudinal axis of the container;

rotating the root and tip ribs away from the longitudinal axis; and extending the horn and sub-reflector along the longitudinal axis.

11. The method of claim 10, wherein the container is a cylindrical container and has a volume smaller than 10×10×16.2 $cm^3$.

12. A method comprising:

providing a deployable antenna, the deployable antenna comprising:

a container;

a deployment mechanism attached to the container;

a hub within the container, configured to deploy along a longitudinal axis of the container upon activation of the deployment mechanism;

a plurality of root ribs attached to the hub and configured to rotate away from the longitudinal axis upon deployment;

a plurality of tip ribs, each tip rib attached to a corresponding root rib by a rotating hinge, the plurality of tip ribs configured to rotate away from the longitudinal axis upon deployment;

a mesh attached to the plurality of root and tip ribs;

a horn attached to the hub, the horn extending along the longitudinal axis and located centrally to the mesh; and a sub-reflector attached to the horn and configured to extend away from the horn along the longitudinal axis upon deployment, wherein the mesh, horn, root ribs, tip ribs and sub-reflector are configured to operate between 2 and 50 GHz;

activating the deployment mechanism, thereby deploying the hub along a longitudinal axis of the container;

rotating the root and tip ribs away from the longitudinal axis; and extending the horn and sub-reflector along the longitudinal axis, wherein the deployment mechanism comprises a cool gas generator attached to a piston, the piston being attached to the hub and configured to push the hub upon activation of the cool gas generator.

13. A method comprising:

providing a deployable antenna, the deployable antenna comprising:

a container;

a deployment mechanism attached to the container;

a hub within the container, configured to deploy along a longitudinal axis of the container upon activation of the deployment mechanism;

a plurality of root ribs attached to the hub and configured to rotate away from the longitudinal axis upon deployment;

a plurality of tip ribs, each tip rib attached to a corresponding root rib by a rotating hinge, the plurality of tip ribs configured to rotate away from the longitudinal axis upon deployment;

a mesh attached to the plurality of root and tip ribs;

a horn attached to the hub, the horn extending along the longitudinal axis and located centrally to the mesh; and a sub-reflector attached to the horn and configured to extend away from the horn along the longitudinal axis upon deployment, wherein the mesh, horn, root ribs, tip ribs and sub-reflector are configured to operate between 2 and 50 GHz;

activating the deployment mechanism, thereby deploying the hub along a longitudinal axis of the container;

rotating the root and tip ribs away from the longitudinal axis; and extending the horn and sub-reflector along the longitudinal axis, wherein the deployment mechanism comprises a plurality of motorized screws.

14. The method of claim 10, wherein a diameter of the deployed antenna is 0.5 m.

15. The method of claim 12, wherein the plurality of root ribs comprises latches to lock onto an outer edge of the container upon deployment.

16. The method of claim 10, wherein the mesh is a 40 openings-per-inch mesh knitted from 0.0008" diameter gold plated Tungsten wire.

17. A deployable antenna comprising:

a container;

a deployment mechanism attached to the container;

a hub within the container, configured to deploy along a longitudinal axis of the container upon activation of the deployment mechanism;

a plurality of root ribs attached to the hub and configured to rotate away from the longitudinal axis upon deployment;

a plurality of tip ribs, each tip rib attached to a corresponding root rib by a rotating hinge, the plurality of tip ribs configured to rotate away from the longitudinal axis upon deployment;

a mesh attached to the plurality of root and tip ribs;

a horn attached to the hub, the horn extending along the longitudinal axis and located centrally to the mesh;

a sub-reflector attached to the horn and configured to extend away from the horn along the longitudinal axis upon deployment;

arms on the root ribs and top ribs;

first slots on the horn;

second slots on the container, wherein:

the arms, first slots and second slots are configured to operate release of, and vibration suppression for, the deployable antenna, and the mesh, horn, root ribs, tip ribs and sub-reflector are configured to operate between 2 and 50 GHz.

18. The deployable antenna of claim 17, wherein the arms, first slots and second slots are configured to time deployment of the sub-reflector and hold the root and top ribs against vibration.

19. The deployable antenna of claim 1, wherein each rotating hinge is a constant force spring hinge comprising a hinge and a constant force spring integrated in one unit.

20. The deployable antenna of claim 19, wherein each constant force spring is mounted on a spool.

21. The deployable antenna of claim 3, wherein the mesh has a surface accuracy of 0.2 mm.

22. The deployable antenna of claim 3, wherein the horn is multi-band, being configured to operate at a plurality of frequency bands.

23. The deployable antenna of claim 4, wherein the deployable antenna is a Cassegrain antenna.

24. The deployable antenna of claim 23, wherein the plurality of motorized screws is four screws.

25. The method of claim 13, wherein the plurality of motorized screws is four screws.

* * * * *